US008765335B2

(12) United States Patent
Tanaka et al.

(10) Patent No.: US 8,765,335 B2
(45) Date of Patent: Jul. 1, 2014

(54) ELECTROPHOTOGRAPHIC PHOTOSENSITIVE MEMBER, PROCESS CARTRIDGE AND ELECTROPHOTOGRAPHIC APPARATUS

(75) Inventors: Daisuke Tanaka, Yokohama (JP); Kazumichi Sugiyama, Numazu (JP); Tsutomu Nishida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 33 days.

(21) Appl. No.: 13/490,419

(22) Filed: Jun. 6, 2012

(65) Prior Publication Data

US 2013/0029256 A1 Jan. 31, 2013

(30) Foreign Application Priority Data

Jul. 29, 2011 (JP) ..... 2011-166764
May 30, 2012 (JP) ..... 2012-123499

(51) Int. Cl.
*G03G 5/00* (2006.01)
*G03G 15/00* (2006.01)

(52) U.S. Cl.
USPC ..... 430/56; 430/58.05; 430/58.85; 430/59.2; 430/66; 430/70; 399/111; 399/159

(58) Field of Classification Search
USPC ..... 430/56, 70, 58.05, 58.85, 59.2, 66; 399/111, 159
See application file for complete search history.

(56) References Cited

U.S. PATENT DOCUMENTS

| | | | | |
|---|---|---|---|---|
| 4,444,861 | A | 4/1984 | Nogami et al. | |
| 4,716,091 | A | 12/1987 | Yoshihara et al. | |
| 5,437,952 | A | 8/1995 | Hirai et al. | |
| 6,562,530 | B2 | 5/2003 | Morikawa et al. | |
| 6,806,009 | B2 | 10/2004 | Tanaka et al. | |
| 6,815,135 | B2 | 11/2004 | Morikawa et al. | |
| 6,835,512 | B2 | 12/2004 | Morikawa et al. | |
| 6,899,983 | B2 | 5/2005 | Tamoto et al. | |
| 6,913,862 | B2 | 7/2005 | Nakata et al. | |
| 6,998,210 | B2 | 2/2006 | Yoshimura et al. | |
| 7,022,446 | B2 | 4/2006 | Yoshimura et al. | |
| 7,078,140 | B2 | 7/2006 | Yoshimura et al. | |
| 2009/0253057 | A1* | 10/2009 | Kurauchi et al. | 430/58.05 |
| 2010/0166454 | A1* | 7/2010 | Taniguchi et al. | 399/111 |
| 2011/0129775 | A1* | 6/2011 | Sawada et al. | 430/109.2 |
| 2011/0158683 | A1 | 6/2011 | Okuda et al. | |

FOREIGN PATENT DOCUMENTS

| | | | |
|---|---|---|---|
| JP | 58-167606 | A | 10/1983 |
| JP | 58-209747 | A | 12/1983 |
| JP | 62-75462 | A | 4/1987 |
| JP | 5-249763 | A | 9/1993 |
| JP | 7-13368 | A | 1/1995 |
| JP | 7-261440 | A | 10/1995 |
| JP | 3278016 | B2 | 4/2002 |
| JP | 2002-128883 | A | 5/2002 |

(Continued)

OTHER PUBLICATIONS

Sugiyama, et al., U.S. Appl. No. 131492,377, filed Jun. 8, 2012.

(Continued)

*Primary Examiner* — Thorl Chea
(74) *Attorney, Agent, or Firm* — Fitzpatrick, Cella, Harper and Scinto

(57) ABSTRACT

The electrophotographic photosensitive member includes a surface layer containing (α), (β) and (γ).

12 Claims, 1 Drawing Sheet

(56) References Cited

FOREIGN PATENT DOCUMENTS

| | | | |
|---|---|---|---|
| JP | 2003-295490 | A | 10/2003 |
| JP | 3781268 | B2 | 5/2006 |
| JP | 2007-47655 | A | 2/2007 |
| JP | 2007-72277 | A | 3/2007 |
| JP | 2007-79555 | A | 3/2007 |
| JP | 2007-199688 | A | 8/2007 |

OTHER PUBLICATIONS

PCT International Search Report and Written Opinion of the International Searching Authority, International Application No. PCT/JP2012/065440, Mailing Date Aug. 28, 2012.

* cited by examiner

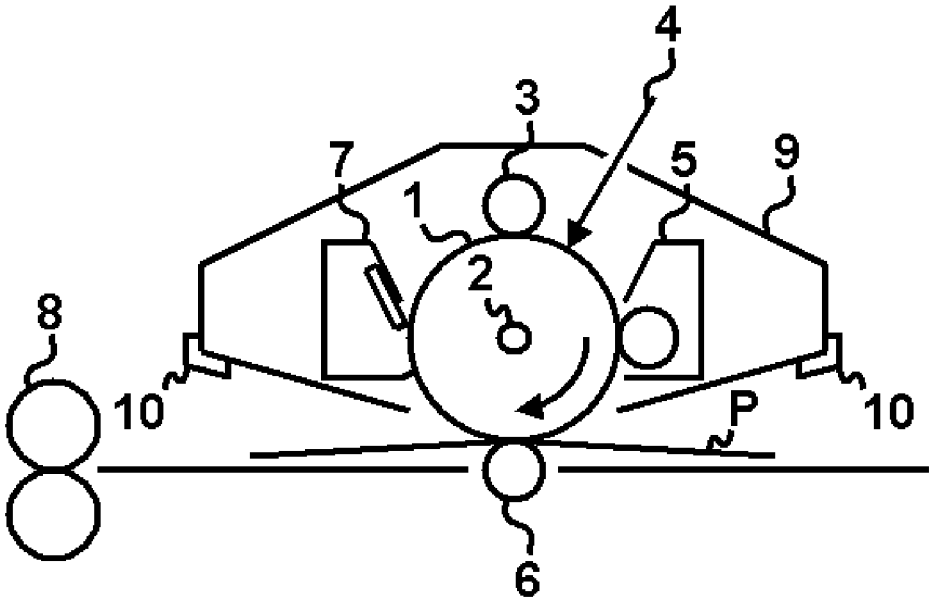
4
3
7
5
9
1
2
8
10
10
P
6

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

The present invention relates to an electrophotographic photosensitive member, a process cartridge and an electrophotographic apparatus.

2. Description of the Related Art

As an electrophotographic photosensitive member to be mounted on an electrophotographic apparatus, an electrophotographic photosensitive member containing an organic photoconductive substance (charge generation substance) is commonly used. As an electrophotographic apparatus repeatedly forms an image, electric and mechanical external forces such as charging, exposing, developing, transferring and cleaning external forces are directly applied to the surface of an electrophotographic photosensitive member, and thus there is a demand for durability to such external forces. Furthermore, there is also a demand for reducing the frictional force to a contacting member (cleaning blade or the like) (lubricating properties and slipping properties) on the surface of an electrophotographic photosensitive member.

In order to solve the problem of lubricating properties, a method of adding a silicone oil such as polydimethylsiloxane to the surface layer of an electrophotographic photosensitive member has been proposed in Japanese Patent Application Laid-Open No. H07-13368. In addition, a method of using a polycarbonate resin having a siloxane structure at the end for the surface layer of an electrophotographic photosensitive member has been proposed in Japanese Patent No. 3278016. In addition, a method of using a polyester resin having a siloxane structure at the end for the surface layer has been proposed in Japanese Patent No. 3781268.

However, if the silicone oil is contained in the surface layer of the electrophotographic photosensitive member as in Japanese Patent Application Laid-Open No. H07-13368, there is a tendency that the surface layer is whitened to cause the reduction in sensitivity to thereby lower image density.

In addition, if the polycarbonate resin and the polyester resin each having a siloxane structure at the end are used as in Japanese Patent No. 3278016 and Japanese Patent No. 3781268, the variation in light area potential due to the repeating use of the electrophotographic photosensitive member is larger as compared with the case of using a resin not having a siloxane structure.

SUMMARY OF THE INVENTION

An object of the present invention is to provide an electrophotographic photosensitive member including a surface layer containing a resin having a siloxane structure at the end, that allows the reduction in initial frictional force (initial friction coefficient) and the suppression of the variation in light area potential due to the repeating use. Another object of the present invention is to provide a process cartridge and an electrophotographic apparatus including such an electrophotographic photosensitive member.

The above objects are achieved according to the following present invention.

The present invention relates to an electrophotographic photosensitive member including a support and a photosensitive layer formed on the support, wherein the electrophotographic photosensitive member includes a surface layer including:

(α) at least one resin selected from the group consisting of a polycarbonate resin not having a siloxane structure at the end and a polyester resin not having a siloxane structure at the end, (β) at least one resin selected from the group consisting of a polycarbonate resin having a siloxane structure at the end, a polyester resin having a siloxane structure at the end, and an acrylic resin having a siloxane structure at the end, and (γ) at least one compound selected from the group consisting of a methyl benzoate, an ethyl benzoate, a benzyl acetate, ethyl 3-ethoxypropionate, and a diethylene glycol ethyl methyl ether.

The present invention also relates to a process cartridge detachably attachable to a main body of an electrophotographic apparatus, wherein the process cartridge integrally supports the electrophotographic photosensitive member, and at least one device selected from the group consisting of a charging device, a developing device, a transferring device, and a cleaning device.

The present invention also relates to an electrophotographic apparatus including the electrophotographic photosensitive member, a charging device, an exposure device, a developing device, and a transferring device.

Advantageous Effects of Invention

According to the present invention, an electrophotographic photosensitive member including a surface layer containing a resin having a siloxane structure at the end, which simultaneously better satisfies the reduction in initial friction coefficient and the suppression of the variation in light area potential due to the repeating use, and a process cartridge and an electrophotographic apparatus including the electrophotographic photosensitive member can be provided.

Further features of the present invention will become apparent from the following description of exemplary embodiments with reference to the attached drawings.

BRIEF DESCRIPTION OF THE DRAWING

FIGURE is a view illustrating one example of a schematic structure of an electrophotographic apparatus provided with a process cartridge including an electrophotographic photosensitive member according to the present invention.

DESCRIPTION OF THE EMBODIMENTS

Preferred embodiments of the present invention will now be described in detail in accordance with the accompanying drawings.

The electrophotographic photosensitive member of the present invention is as described above, an electrophotographic photosensitive member including a support and a photosensitive layer formed on the support, wherein the electrophotographic photosensitive member includes a surface layer containing as constituent elements, the above (α) (constituent element (α)), the above (β) (constituent element (β)) and the above (γ) (constituent element (γ)). Hereinafter, the above (α) is also referred to as "resin α", the above (β) is also referred to as "resin β" and the above (γ) is also referred to as "compound γ".

The present inventors presume that the reason why the surface layer includes the compound γ of the present invention to thereby exhibit the effect of simultaneously better satisfying the reduction in initial friction coefficient and the suppression of the variation in light area potential due to the repeating use in the electrophotographic photosensitive member is as follows.

It is presumed that the resin β in the surface layer serves as a barrier against the charge-passing from the lower layer of the surface layer (e.g., charge generation layer) to the surface layer (e.g., charge transport layer), thereby resulting in causing the increase in light area potential. It is considered that the compound γ functions to promote the charge-passing from the lower layer of the surface layer to the surface layer.

<Regarding Resin α>

The resin α represents at least one resin of a polycarbonate resin not having a siloxane structure at the end and a polyester resin not having a siloxane structure at the end. The polycarbonate resin not having a siloxane structure at the end more specifically means polycarbonate resin not having a siloxane structure at the both ends. The polyester resin not having a siloxane structure at the end more specifically means a polyester resin not having a siloxane structure at the both ends.

In the present invention, the polycarbonate resin not having a siloxane structure at the end can be a polycarbonate resin A having a repeating structural unit represented by the following formula (A). The polyester resin not having a siloxane structure at the end can be a polyester resin B having a repeating structure represented by the following formula (B).

(A)

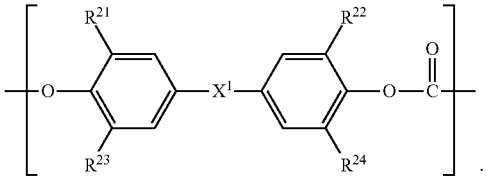

In the formula (A), $R^{21}$ to $R^{24}$ each independently represents a hydrogen atom or a methyl group. $X^1$ represents a single bond, a cyclohexylidene group, or a divalent group having a structure represented by the following formula (C).

(B)

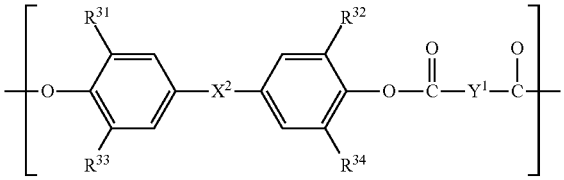

In the formula (B), $R^{31}$ to $R^{34}$ each independently represents a hydrogen atom or a methyl group. $X^2$ represents a single bond, a cyclohexylidene group, or a divalent group having a structure represented by the following formula (C).

$Y^1$ represents a m-phenylene group, a p-phenylene group, or a divalent group having two p-phenylene groups bounded with an oxygen atom.

(C)

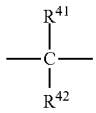

In the formula (C), $R^{41}$ and $R^{42}$ each independently represents a hydrogen atom, a methyl group or a phenyl group.

Specific examples of the repeating structural unit of the polycarbonate resin A represented by the formula (A) are illustrated below.

(A-1)

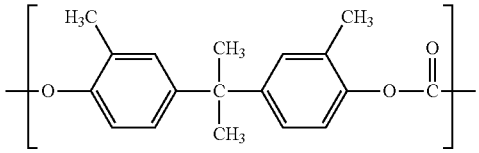

(A-2)

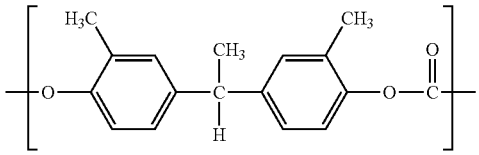

(A-3)

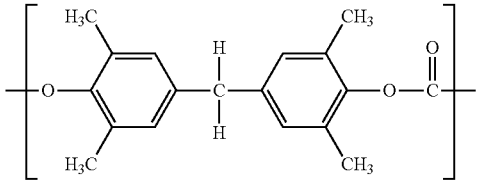

(A-4)

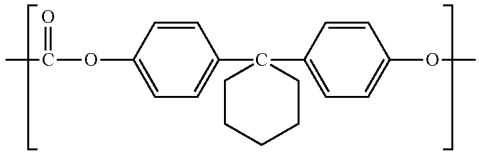

(A-5)

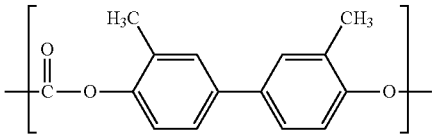

(A-6)

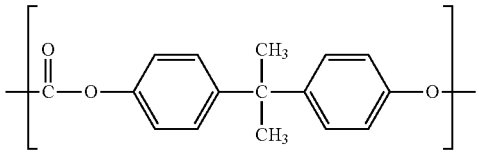

(A-7)

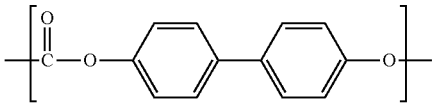

-continued (A-8)

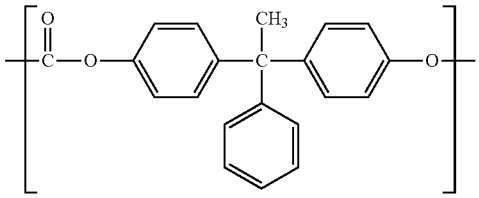

The polycarbonate resin A may be a polymer of one of the structural units of the above (A-1) to (A-8), or may be a copolymer of two or more thereof. Among them, the repeating structural units represented by the formulas (A-1), (A-2) and (A-4) are preferable.

Specific examples of the repeating structural unit of the polyester resin B represented by the formula (B) are illustrated below.

(B-1)

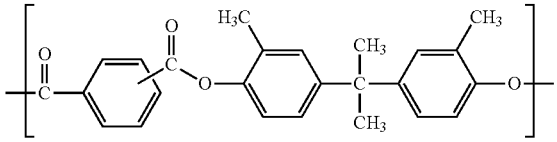

(B-2)

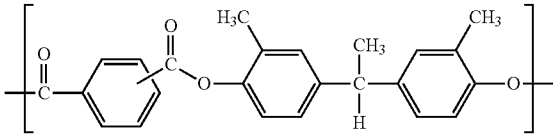

(B-3)

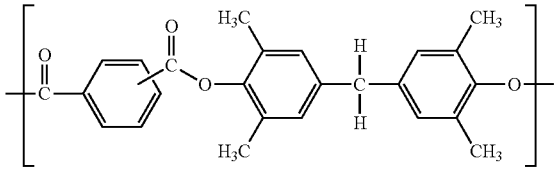

(B-4)

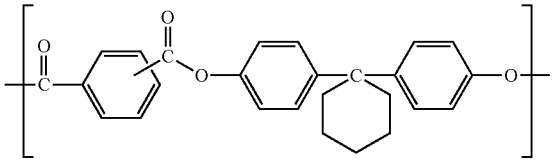

(B-5)

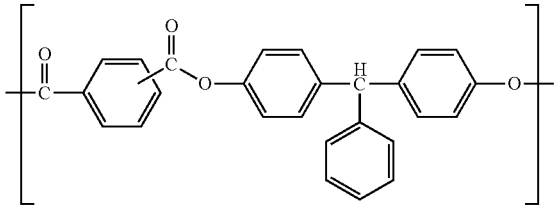

(B-6)

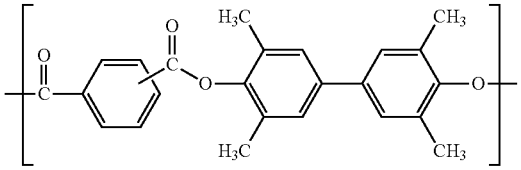

(B-7)

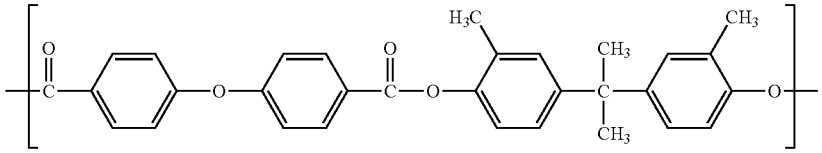

(B-8)

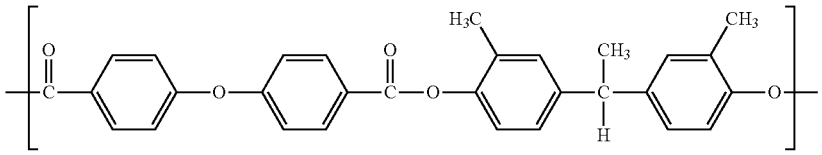

(B-9)

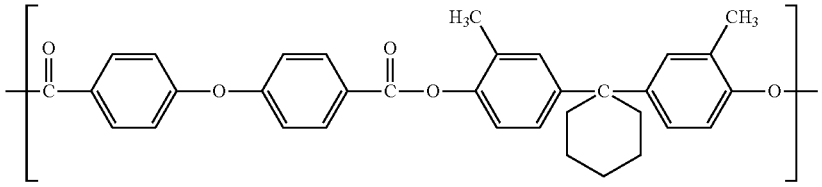

The polyester resin B may be a polymer of one of the structural units of the above (B-1) to (B-9), or may be a copolymer of two or more thereof. Among them, the repeating structure represented by the formulas (B-1), (B-2), (B-3), (B-6), (B-7) and (B-8) are preferable.

The polycarbonate resin A and the polyester resin B can be synthesized by, for example, a conventional phosgene method, and can also be synthesized by an interesterification method.

The copolymerization forms of the polycarbonate resin A and the polyester resin B may be any of block copolymerization, random copolymerization, alternating copolymerization and the like.

The polycarbonate resin A and the polyester resin B can be synthesized by any, known method, and can be synthesized by the method described in, for example, Japanese Patent Application Laid-Open No. 2007-047655 or Japanese Patent Application Laid-Open No. 2007-072277.

The weight average molecular weight of each of the polycarbonate resin A and the polyester resin B is preferably not less than 20,000 and not more than 300,000, and more preferably not less than 50,000 and not more than 200,000. In the present invention, the weight average molecular weight of the resin means a weight average molecular weight in terms of polystyrene measured by the method described in Japanese Patent Application Laid-Open No. 2007-79555 according to the common method.

The polycarbonate resin A and the polyester resin B as the resin α may be a copolymer having a repeating structural unit containing a siloxane structure besides the structural unit represented by the formula (A) or the formula (B). Specific examples include repeating structural units represented by the following formulas (H-1) and (H-2). The polycarbonate resin A and the polyester resin B may further have a repeating structural unit represented by the following formula (H-3).

(H-1)

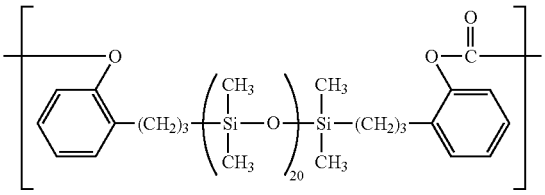

(H-2)

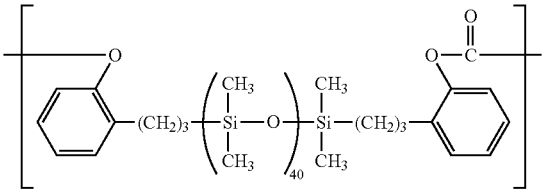

(H-3)

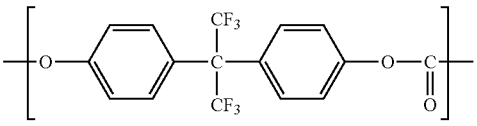

Specific resins to be used as the resin α are shown below.

TABLE 1

| Component [α] (Polycarbonate Resin A•Polyester Resin B) | Repeating structural unit | Ratio of repeating structural units (mass ratio) | Weight average molecular weight (Mw) |
|---|---|---|---|
| Resin A(1) | (A-4) | — | 55,000 |
| Resin A(2) | (A-4) | — | 14,000 |
| Resin A(3) | (A-4) | — | 110,000 |
| Resin A(4) | (A-6) | — | 55,000 |
| Resin A(5) | (A-1) | — | 54,000 |
| Resin A(6) | (A-6)/(A-1) | 6.5/3.5 | 55,000 |
| Resin A(7) | (A-4)/(H-1) | 9/1 | 55,000 |
| Resin A(8) | (A-4)/(H-1) | 9/1 | 110,000 |
| Resin A(9) | (A-4)/(H-1)/(H-3) | 6/1.5/2.5 | 60,000 |
| Resin B(1) | (B-1) | — | 120,000 |
| Resin B(2) | (B-1)/(B-6) | 7/3 | 120,000 |
| Resin B(3) | (B-8) | — | 100,000 |

In Table 1, with respect to the resin B(1) and the repeating structural units represented by the formulas (B-1) and (B-6) in the resin B(2), the molar ratio of a terephthalic acid structure to an isophthalic acid structure (terephthalic acid backbone:isophthalic acid backbone) is 5/5.

<Regarding Resin β>

The resin β has at least one resin selected from the group consisting of a polycarbonate resin having a siloxane structure at the end, a polyester resin having a siloxane structure at the end, and an acrylic resin having a siloxane structure at the end. The polycarbonate resin having a siloxane structure at the end includes a polycarbonate resin having a siloxane structure at the end of only one side and a polycarbonate resin having a siloxane structure at the both ends. The polyester resin having a siloxane structure at the end includes a polyester resin having a siloxane structure at the end of only one side and a polyester resin having a siloxane structure at the both ends. The acrylic resin having a siloxane structure at the end includes an acrylic resin having a siloxane structure at the end of only one side and an acrylic resin having a siloxane structure at the both ends.

In the present invention, the polycarbonate resin, the polyester resin and the acrylic resin each having a siloxane structure at the end are used to thereby make compatibility of the resin β with the resin of the resin a favorable and maintain a higher mechanical durability. The incorporation of a siloxane moiety at the end enables having high lubricating properties and reducing the initial friction coefficient. The reason for this is considered to be due to the following that the incorporation of a dimethylpolysiloxane (siloxane) moiety at the end allows such a siloxane portion to have a high degree of freedom and high surface migration properties and to be easily present on the surface of the photosensitive member.

In the present invention, the polycarbonate resin having a siloxane structure at the end can be polycarbonate resin D having a repeating structural unit represented by the following formula (A') and an end structure represented by the following formula (D). The polyester resin having a siloxane structure at the end can also be a polyester resin E having a repeating structural unit represented by the following formula (B') and an end structure represented by the following formula (D).

(A')

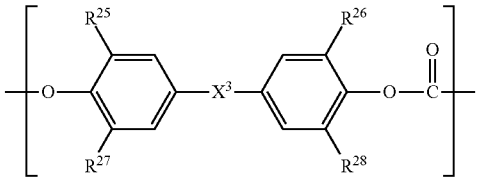

In the formula (A'), $R^{25}$ to $R^{28}$ each independently represents a hydrogen atom or a methyl group. $X^3$ represents a single bond, a cyclohexylidene group, or a divalent group having a structure represented by the following formula (C').

(B')

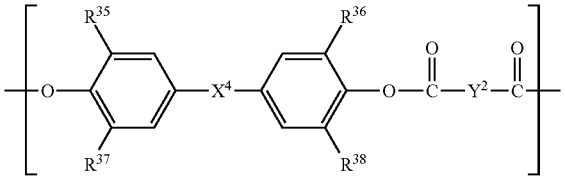

In the formula (B'), $R^{35}$ to $R^{38}$ each independently represents a hydrogen atom or a methyl group. $X^4$ represents a single bond, a cyclohexylidene group, or a divalent group having a structure represented by the following formula (C'). $Y^2$ represents a m-phenylene group, a p-phenylene group, or a divalent group having two p-phenylene groups bound with an oxygen atom.

(C')

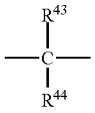

In the formula (C'), $R^{43}$ and $R^{44}$ each independently represents a hydrogen atom, a methyl group or a phenyl group.

(D)

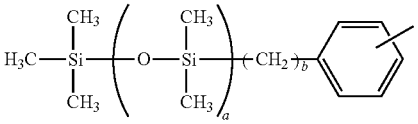

In the formula (D), a and b represent the number of the repetition of the structure within the bracket. The average value of a is not less than 20 and not more than 100, and the average value of b is not less than 1 and not more than 10, based on the polycarbonate resin D or the polyester resin E. More preferably, the average value of a is not less than 30 and not more than 60, and the average value of b is not less than 3 and not more than 10.

In the present invention, the polycarbonate resin D and the polyester resin E have the end structure represented by the formula (D) at one end or both ends of the resin. In the case where the resin D and the resin E have the end structure represented by the formula (D) at one end, a molecular weight regulator (end terminator) is used. The molecular weight regulator includes phenol, p-cumylphenol, p-tert-butylphenol and benzoic acid. In the present invention, the molecular weight regulator can be phenol or p-tert-butylphenol.

In the case where the resin D and the resin E have the end structure represented by the formula (D) at one end, the structure at the other one end (other end structure) is a structure represented below.

—OH (G-1)

(G-2)

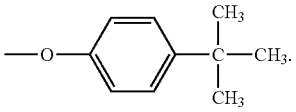

Specific examples of the end siloxane structure represented by the formula (D) are illustrated below.

(D-1)

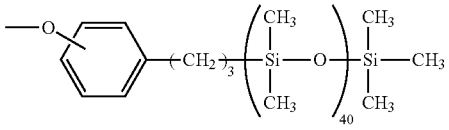

(D-2)

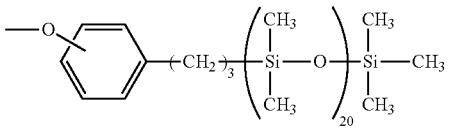

(D-3)

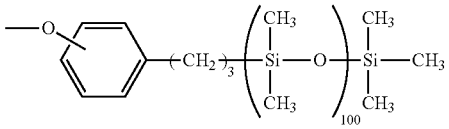

(D-4)

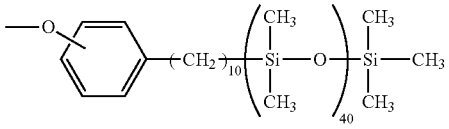

(D-5)

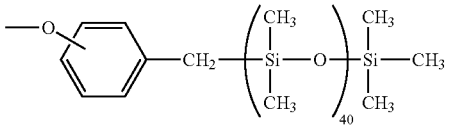

In the polycarbonate resin D, specific examples of the repeating structural unit represented by the formula (A') include the repeating structural units represented by the formulas (A-1) to (A-8). The repeating structural unit represented by the formulas (A-1), (A-2) and (A-4) are preferable. In the polyester resin E, specific examples of the repeating structural unit represented by the formula (B') include the repeating structural units represented by the formulas (B-1) to (B-9). The repeating structural unit represented by the formulas (B-1), (B-2), (B-3), (B-6), (B-7) and (B-8) are preferable. Among them, the repeating structural units represented by the formulas (A-4), (B-1) and (B-3) are particularly preferable.

As the polycarbonate resin D and the polyester resin E, one or two or more of the repeating structural units represented by formulas (A-1) to (A-8) or the repeating structural units represented by formulas (B-1) to (B-9) can be used alone, can be mixed, or can be used as a copolymer. The copolymerization forms of the polycarbonate resin D and the polyester resin E may be any of block copolymerization, random copolymerization, alternating copolymerization and the like. The polycarbonate resin D and the polyester resin E may also have the repeating structural unit having a siloxane structure in the main chain, and may also be, for example, a copolymer having a repeating structural unit represented by the following formula (H).

(H)

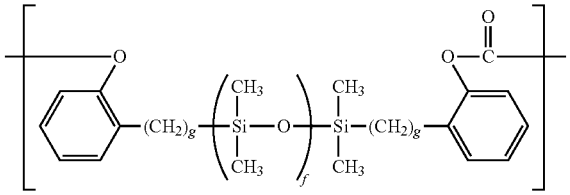

In the formula (H), f and g represent the number of the repetition of the structure within the bracket. The average value of f can be not less than 20 and not more than 100, and the average value of g can be not less than 1 and not more than 10, based on the polycarbonate resin D or the polyester resin E. Specific repeating structural units as the repeating structural unit represented by the formula (H) include the formulas (H-1) and (H-2).

In the present invention, the siloxane moiety in the polycarbonate resin D and the polyester resin E refer's to a moiety in a dotted flame of an end structure represented by the following formula (D-S). In the case where the polycarbonate resin D and the polyester resin E have the repeating structural unit represented by the formula (H), a structure in a dotted flame of a repeating structure represented by the following formula (H-S) is also included in the siloxane moiety.

(D-S)

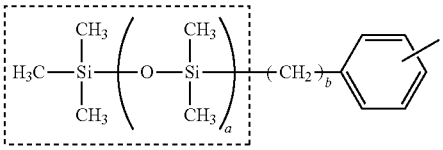

(H-S)

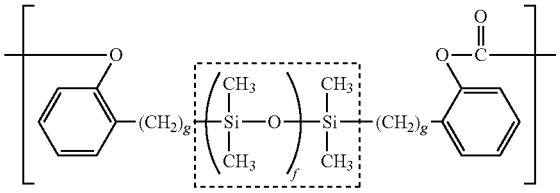

In the present invention, the polycarbonate resin D and the polyester resin E can be synthesized by any known method, and can be synthesized by the method described in, for example, Japanese Patent Application Laid-Open No. 2007-199688. Also in the present invention, the same method was used and raw materials according to the polycarbonate resin D and the polyester resin E were used, thereby synthesizing the polycarbonate resin D and the polyester resin E shown in Synthesis Examples in Table 2. Herein, the polycarbonate resin D and the polyester resin E were purified as follows: the resin D and the resin E were fractioned and separated from each other by using size exclusion chromatography, and then each fractioned component was measured by means of $^1$H-NMR to determine a composition of each resin by the relative ratio of the siloxane moiety in each resin. The weight average molecular weights and the contents of the siloxane moieties in the synthesized polycarbonate resin D and the polyester resin E are shown in Table 2.

Specific examples of the polycarbonate resin D and the polyester resin E are shown below.

TABLE 2

| Component [β] (Polycarbonate resin D• Polyester resin E) | Repeating structural unit in main chain | Siloxane structure at end | Other end structure | Content of siloxane moiety (% by mass) | Weight average molecular weight (Mw) |
|---|---|---|---|---|---|
| Resin D(1) | (A-4) | (D-1) | — | 23% | 50,000 |
| Resin D(2) | (A-2) | (D-5) | — | 25% | 48,000 |
| Resin D(3) | (A-4)/(H-2) | (D-1) | — | 32% | 54,000 |
| Resin D(4) | (A-4) | (D-1) | (G-2) | 12% | 49,000 |
| Resin E(1) | (B-1) | (D-1) | — | 22% | 42,000 |

In Table 2, the mass ratio of each repeating structural unit in the main chain in the resin D(3) satisfies (A-4):(H-2)=9:1.

In the present invention, the acrylic resin having a siloxane structure at the end can be an acrylic resin F having a repeating structural unit represented by the following formula (F-1) and a repeating structural unit represented by the following formula (F-2), or an acrylic resin F having a repeating structural unit represented by the following formula (F-1) and a repeating structural unit represented by the following formula (F-3).

(F-1)

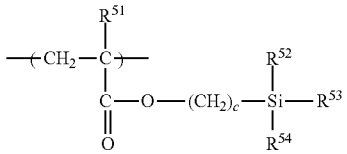

$R^{51}$ represents hydrogen or a methyl group. c represents the number of the repetition of the structure within the bracket, and the average value of c is not less than 0 and not more than 5, based on the acrylic resin F. $R^{52}$ to $R^{54}$ each independently represents a structure represented by the following formula (F-1-2), a methyl group, a methoxy group or a phenyl group. At least one of $R^{52}$ to $R^{54}$ has a structure represented by the following structure (F-1-2).

(F-1-2)

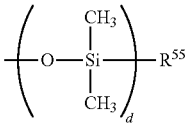

In the formula (F-1-2), d represents the number of the repetition of the structure within the bracket, and the average value of d is not less than 10 and not more than 50, based on the acrylic resin F. $R^{55}$ represents a hydroxyl group or a methyl group.

(F-2)

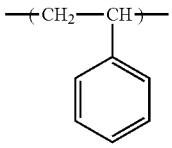

(F-3)

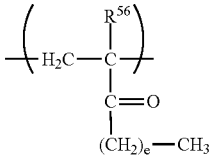

In the formula (F-3), $R^{56}$ represents hydrogen, a methyl group or a phenyl group. e represents 0 or 1.

In the present invention, the siloxane moiety in the acrylic resin F refers to a moiety in a dotted flame of a structure represented by the following formula (F-S) or formula (F-T).

(F-S)

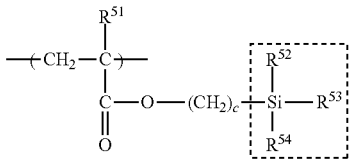

(F-T)

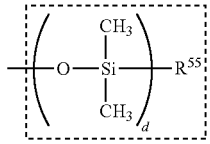

Specific examples of the repeating structural unit in the acrylic resin F are shown in Table 3 below.

TABLE 3

| Compound Example | (F-1) | (F-2) or (F-3) | Weight ratio of repeating structure units | Weight average molecular weight Mw |
|---|---|---|---|---|
| F-A | 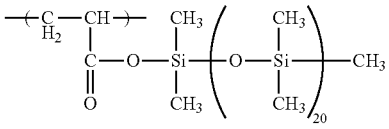 | 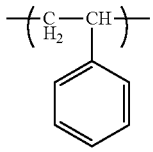 | 2/8 | 105,000 |
| F-B | 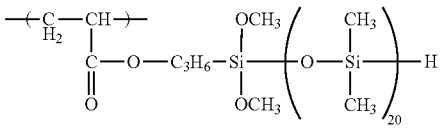 | 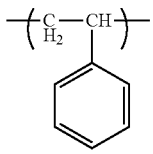 | 2/8 | 100,000 |
| F-C | 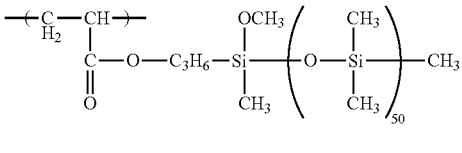 | 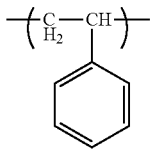 | 1/9 | 100,000 |
| F-D | 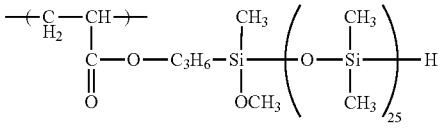 | 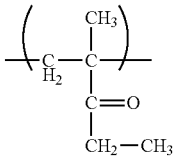 | 1/9 | 105,000 |
| F-E | 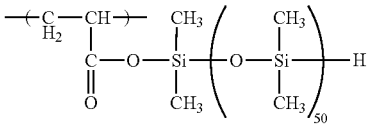 | 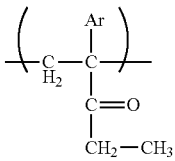 | 2/8 | 110,000 |

TABLE 3-continued

| Compound Example | (F-1) | (F-2) or (F-3) | Weight ratio of repeating structure units | Weight average molecular weight Mw |
|---|---|---|---|---|
| F-F | 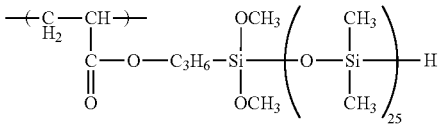 | 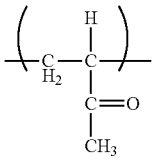 | 1.5/8.5 | 100,000 |
| F-G | 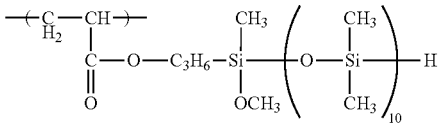 | 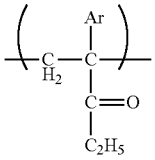 | 1/9 | 110,000 |

Among the acrylic resins F represented by the above Table 3, resins represented by Compound Examples (F-B) and (F-E) are preferable.

These acrylic resins can be synthesized by any known method, for example, the method described in Japanese Patent Application Laid-Open No. S58-167606 or Japanese Patent Application Laid-Open No. S62-75462.

The content of the resin β contained in the surface layer of the electrophotographic photosensitive member according to the present invention is preferably not less than 0.1% by mass and not more than 50% by mass based on the total mass of the resin α, from the viewpoints of the reduction in initial friction coefficient and the suppression of the variation in light area potential due to the repeating use. The content is more preferably not less than 1% by mass and not more than 50% by mass.

<Regarding Compound γ>

The surface layer of the present invention includes as the compound γ, at least one of a methyl benzoate, an ethyl benzoate, a benzyl acetate, ethyl 3-ethoxypropionate, and a diethylene glycol ethyl methyl ether.

The surface layer includes these compounds to thereby obtain the effect of suppressing the variation in light area potential due to the repeating use. The content of the compound γ can be not less than 0.001% by mass and not more than 1% by mass based on the total mass of the surface layer, thereby simultaneously better satisfying the reduction in initial friction coefficient and the suppression of the variation in light area potential due to the repeating use, and making abrasion resistance favorable. The content of the compound γ can also be not less than 0.001% by mass and not more than 0.5% by mass from the viewpoint of deformation due to an abutting member at the time of being left to stand for a long period.

In the present invention, a coat is formed by allowing the compound γ to be contained in a surface-layer coating solution, coating the surface-layer coating solution on the support, and heating and drying the resultant, and thereby the surface layer including the compound γ is formed.

In the present invention, since the compound γ is easily volatilized by the heating and drying step at the time of forming the surface layer, the content of the compound γ to be added to the surface-layer coating solution can be larger than the content of the compound γ contained in the surface layer. Therefore, the content of the compound γ to be added to the surface-layer coating solution is preferably not less than 5% by mass and not more than 50% by mass, and more preferably not less than 5% by mass and not more than 15% by mass, based on the total weight of the surface-layer coating solution.

The content of the compound γ in the surface layer can be measured by the following method. The content was measured by using HP7694 Headspace sampler (manufactured by Agilent Technologies) and HP6890 series GS System (manufactured by Agilent Technologies). The surface layer of the produced electrophotographic photosensitive member was cut out to a piece of 5 mm×40 mm (sample piece), the piece was placed into a vial, Headspace sampler (HP7694 Headspace sampler) was set as follows: the temperature of Oven was 150° C., the temperature of Loop was 170° C., and the temperature of Transfer Line 190° C.; and generated gas was measured by gas chromatography (HP6890 series GS System). After the measurement, the mass of the surface layer was determined by the difference between the mass of the sample piece taken out from the vial and the mass of the sample piece from which the surface layer was peeled off. The sample piece from which the surface layer was peeled off was a sample piece obtained by dipping the taken out sample piece in methylethyl ketone for 5 minutes to peel off the surface layer of the sample piece, and then drying the resultant at 100° C. for 5 minutes. Also in the present invention, the content of the compound γ in the surface layer was measured by using the above-described method.

Then, the configuration of the electrophotographic photosensitive member according to the present invention will be described.

The electrophotographic photosensitive member according to the present invention includes a support and a photosensitive layer formed on the support. The photosensitive layer includes a one-layer type photosensitive layer containing a charge transport substance and a charge generation substance in one layer; and a laminate type (functional separation type) photosensitive layer in which a charge generation layer containing a charge generation substance and a charge transport layer containing a charge transport substance are separated from each other. The laminate type photosensitive layer can be used in the present invention. The charge generation layer may have a laminated structure, and the charge transport layer may have a laminated configuration. For the purpose of enhancing durability of the electrophotographic photosensitive member, a protective layer may be formed on the photosensitive layer.

With respect to the surface layer of the electrophotographic photosensitive member according to the present invention, when the charge transport layer is the topmost surface, the charge transport layer is the surface layer, and on the other hand, when the protective layer is provided on the charge transport layer, the protective layer is the surface layer.

<Conductive Support>

The support means a support having conductivity (conductive support). Examples of the support include supports made of metals such as aluminum, stainless, copper, nickel and zinc or alloys of such metals. In the case where the support is made of aluminum or an aluminum alloy, an ED pipe, an EI pipe, or a pipe obtained by subjecting these pipes to cutting, electrolytic composite polishing (electrolysis with an electrode having electrolytic action and an electrolytic solution and polishing with a grinding stone having polishing action), and a wet-process or dry-process honing treatment can also be used. The support also includes a support made of metal and a support where a conductive material such as aluminum, an aluminum alloy or an indium oxide-tin oxide alloy is formed on a resin support in the form of a thin film.

A support where conductive particles such as carbon black, tin oxide particles, titanium oxide particles or silver particles are impregnated with a resin or the like, and a plastic having a conductive binder resin can also be used.

For the purpose of preventing interference fringes caused by scattering of laser light or the like, the surface of the conductive support may be subjected to a cutting, surface roughening or alumite treatment.

In the electrophotographic photosensitive member according to the present invention, a conductive layer having conductive particles and a resin may be provided on the support. The conductive layer is a layer obtained by using a conductive-layer coating solution in which conductive particles are dispersed in a binder resin.

The conductive particles include carbon black, acetylene black, powders of metals such as aluminum, nickel, iron, nichrome, copper, zinc and silver, and powders of metal oxides such as conductive tin oxide and ITO.

The binder resin to be used for the conductive layer includes a polyester resin, a polycarbonate resin, polyvinylbutyral, an acrylic resin, a silicone resin, an epoxy resin, a melamine resin, a urethane resin, a phenol resin and an alkyd resin.

The solvent for the conductive-layer coating solution includes an ether-type solvent, an alcohol-type solvent, a ketone-type solvent and an aromatic hydrocarbon solvent. The film thickness of the conductive layer is preferably not less than 0.2 μm and 40 μm or less, more preferably not less than 1 μm and not more than 35 μm, and still more preferably not less than 5 μm and not more than 30 μm.

An intermediate layer may be provided between the conductive support or the conductive layer and the photosensitive layer. The intermediate layer is formed for improving the adhesion properties of the photosensitive layer, coating properties, and charge injection properties from the conductive support, and protecting the photosensitive layer against electric fracture.

The intermediate layer can be formed by applying an intermediate-layer coating solution containing a binder resin on the conductive support or the conductive layer, and drying or curing the resultant.

The binder resin of the intermediate layer includes polyacrylic acids, methylcellulose, ethylcellulose, a polyamide resin, a polyimide resin, a polyamideimide resin, a polyamide acid resin, a melamine resin, an epoxy resin and a polyurethane resin. The binder resin to be used for the intermediate layer can be a thermoplastic resin, and can be specifically a thermoplastic polyamide resin. The polyamide resin can be a low crystalline or non-crystalline copolymerized nylon so as to be applied in the state of a solution.

The solvent for the intermediate-layer coating solution includes an ether-type solvent, an alcohol-type solvent, a ketone-type solvent and an aromatic hydrocarbon solvent. The film thickness of the intermediate layer is preferably not less than 0.05 μm and not more than 40 μm, and more preferably not less than 0.1 μm and not more than 30 μm. The intermediate layer may contain semi-conductive particles or an electron transport substance, or an electron-accepting substance.

<Photosensitive Layer>

The photosensitive layer (charge generation layer, charge transport layer) is formed on the conductive support, the conductive layer or the intermediate layer.

The charge generation substance to be used for the electrophotographic photosensitive member according to the present invention includes an azo pigment, a phthalocyanine pigment, an indigo pigment and a perylene pigment. One or two or more of such charge generation substances may be used. Among them, oxytitanium phthalocyanine, hydroxygallium phthalocyanine and chlorogallium phthalocyanine are particularly preferable because of a high sensitivity.

The binder resin to be used for the charge generation layer includes a polycarbonate resin, a polyester resin, a butyral resin, a polyvinylacetal resin, an acrylic resin, a vinyl acetate resin and a urea resin. Among them, a butyral resin is particularly preferable. One or two or more of the above resins can be used alone, can be mixed, or can be used as a copolymer.

The charge generation layer can be formed by applying an charge generation-layer coating solution obtained by dispersing a charge generation substance along with a binder resin and a solvent and drying the resultant. The charge generation layer may be a film formed by vapor depositing the charge generation substance.

Examples of a dispersing method includes a method using a homogenizer, an ultrasonic wave, a ball mill, a sand mill, an attritor or a roll mill.

With respect to the proportion of the charge generation substance to the binder resin, the proportion of the charge generation substance is preferably within a range of not less than 0.1 parts by mass and not more than 10 parts by mass, and more preferably not less than 1 part by mass and not more than 3 parts by mass, based on 1 part by mass of the resin.

The solvent to be used for the charge generation-layer coating solution includes an alcohol-type solvent, a sulfoxide-type solvent, a ketone-type solvent, an ether-type solvent, an ester-type solvent or an aromatic hydrocarbon solvent.

The film thickness of the charge generation layer is preferably not less than 0.01 μm and not more than 5 μm, and more preferably not less than 0.1 μm and not more than 2 μm.

A variety of sensitizers, antioxidants, ultraviolet absorbers plasticizers and the like can also be added to the charge generation layer where necessary. In order not to interrupt the flow of a charge (carrier) in the charge generation layer, the charge generation layer may contain the electron transport substance and the electron-accepting substance.

In the electrophotographic photosensitive member including the laminate type photosensitive layer, the charge transport layer is provided on the charge generation layer.

The charge transport substance to be used in the present invention includes a triarylamine compound, a hydrazone compound, a styryl compound and a stilbene compound. The charge transport substance can be any of compounds represented by the following structural formulas (CTM-1) to (CTM-7).

(CTM-1)

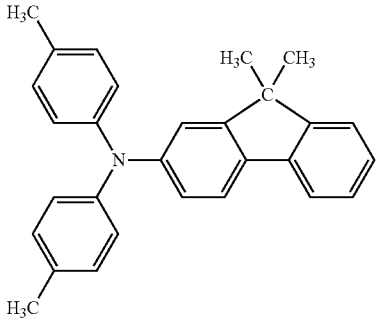

(CTM-2)

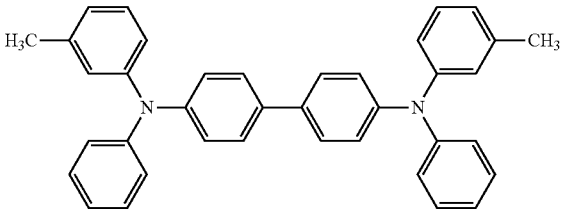

(CTM-3)

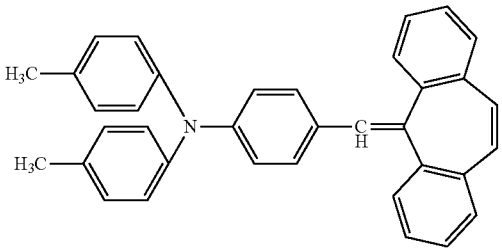

(CTM-4)

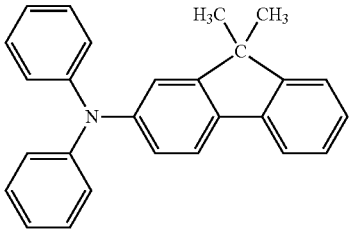

(CTM-5)

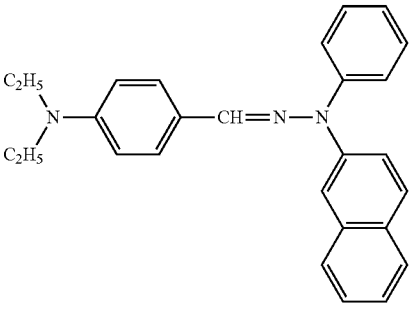

-continued (CTM-6)

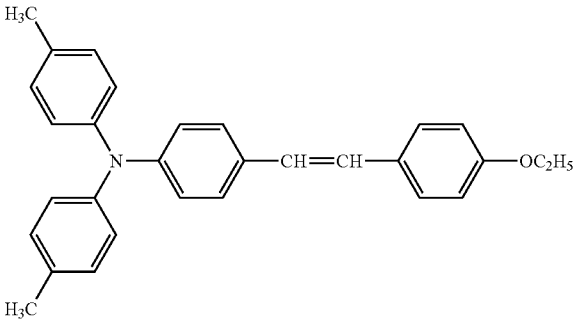

(CTM-7)

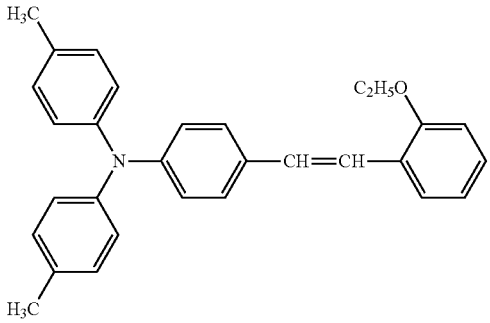

The charge transport layer can be formed by applying the charge transport-layer coating solution obtained by dissolving the charge transport substance and the binder resin in the solvent, and drying the resultant.

In the present invention, when the charge transport layer is the surface layer, the binder resin containing the resin α and the resin β is used, and may be used while being further mixed with other resin. Such other resin to be mixed that may be used is described above.

The film thickness of the charge transport layer is preferably 5 to 50 μm, and more preferably 10 to 30 μm. The mass ratio of the charge transport substance to the binder resin is 5:1 to 1:5, and is preferably 3:1 to 1:3.

The solvent to be used for the charge transport-layer coating solution includes an alcohol-type solvent, a sulfoxide-type solvent, a ketone-type solvent, an ether-type solvent, an ester-type solvent and an aromatic hydrocarbon solvent. The solvent can be xylene, toluene or tetrahydrofuran.

A variety of additives may be added to the respective layers of the electrophotographic photosensitive member according to the present invention. Examples of the additives include degradation inhibitors such as an antioxidant, an ultraviolet absorber and a light stabilizer, and fine particles such as organic fine particles and inorganic fine particles.

The degradation inhibitors include hindered phenol-type antioxidants, hindered amine-type light stabilizers, sulfur atom-containing antioxidants and phosphorus atom-containing antioxidants.

The organic fine particles include fluorine atom-containing resin particles, and polymer resin particles such as polystyrene fine particles and polyethylene resin particles. Examples of the inorganic fine particles include metal oxides such as silica and alumina.

When the above respective layer coating solutions are applied, any coating method such as a dip coating method, a spray coating method, a spinner coating method, a roller coating method, a Meyer bar coating method and a blade coating method can be used. Among the methods, a dip coating method can be used.

The drying temperature for drying the above respective layer coating solutions to form the respective coats can be 60° C. or higher and 150° C. or lower. In particular, the drying temperature for drying the charge transport-layer coating solution (surface-layer coating solution) can be 110° C. or higher and 140° C. or lower. The drying time is preferably 10 to 60 minutes, and more preferably 20 to 60 minutes.

[Electrophotographic Apparatus]

FIGURE illustrates one example of a schematic structure of an electrophotographic apparatus provided with a process cartridge having the electrophotographic photosensitive member according to the present invention.

In FIGURE, reference number 1 denotes a cylindrical electrophotographic photosensitive member, which is rotatably driven at a predetermined circumferential speed around an axis 2 in the direction shown by an arrow. The surface of the electrophotographic photosensitive member 1 to be rotatably driven is uniformly charged to a predetermined, negative potential by a charging device (primary charging device: charging roller or the like) 3 in the course of rotation. Then, the charged electrophotographic photosensitive member is subjected to exposure light (image exposure light) 4 which is emitted from an exposure device (not illustrated) such as a slit exposure device or a laser beam scanning exposure device and whose intensity has been modulated according to the time-series electric digital image signal of the intended image information. In this way, an electrostatic latent image according to the intended image is sequentially formed on the surface of the electrophotographic photosensitive member 1.

The electrostatic latent image formed on the surface of the electrophotographic photosensitive member 1 is developed with a toner contained in a developer of a developing device 5 by reverse developing to be formed into a toner image. Then, the toner image formed and supported on the surface of the electrophotographic photosensitive member 1 is sequentially transferred to a transfer material (paper or the like) P with a transfer bias from a transferring device (transfer roller or the like) 6. Herein, the transfer material P is taken out from a transfer material feed device (not illustrated) in synchronous with the rotation of the electrophotographic photosensitive member 1, and fed to a portion (abutting portion) between the electrophotographic photosensitive member 1 and the transferring device 6. A bias voltage having a polarity opposite to the polarity of the charge possessed by the toner is applied to the transferring device 6 from a bias supply (not illustrated).

The transfer material P to which the toner image is transferred is separated from the surface of the electrophotographic photosensitive member 1 and conveyed to a fixing device 8, and is subjected to a treatment of fixing the toner image and conveyed outside the apparatus as an image-formed material (printed or copied material).

The surface of the electrophotographic photosensitive member 1, on which the toner image is transferred, is cleaned by a cleaning device (cleaning blade or the like) 7 so that a transfer residual developer (post-transfer residual toner) is removed. Then, the surface is subjected to a neutralization treatment with pre-exposure light (not illustrated) from a pre-exposure device (not illustrated), and thereafter repeatedly used for image forming. Herein, when the charging device 3 is a contact charging device using a charging roller or the like as illustrated in FIGURE, such pre-exposing is not necessarily required.

In the present invention, a plurality of constituent elements selected from the electrophotographic photosensitive member 1, the charging device 3, the developing device 5, the transferring device 6, the cleaning device 7 and the like may be accommodated in a container to be integrally supported as a process cartridge. Such a process cartridge may be detachably attachable to the main body of the electrophotographic apparatus such as a copier or a laser beam printer. In FIGURE, the electrophotographic photosensitive member 1, the charging device 3, the developing device 5 and the cleaning device 7 are integrally supported to be formed into a cartridge, and thus set up to a process cartridge 9 detachably attachable to the main body of the electrophotographic apparatus by using a guiding device 10 such as a rail provided in the main body of the electrophotographic apparatus.

EXAMPLES

Hereinafter, the present invention will be described in more detail with reference to specific Examples and Comparative Examples. It is to be noted that the present invention is not limited to the Examples and Comparative Examples. Herein, "part(s)" in Examples is meant to be "part(s) by mass". The results of the Examples 1 to 147 and Comparative Examples 1 to 60 below are shown in Tables 13 to 16.

Example 1

An aluminum cylinder of 24 mm in diameter and 261.6 mm in length was used as a support (conductive support).

Then, 10 parts of $SnO_2$-coated barium sulfate (conductive particles), 2 parts of titanium oxide (pigment for resistance modification), 6 parts of a phenol resin (binder resin), 0.001 parts of silicone oil (leveling agent) and a mixed solvent of 4 parts of methanol and 16 parts of methoxypropanol were used to prepare a conductive-layer coating solution.

The conductive-layer coating solution was applied onto the support by dip coating and cured (heat cured) at 140° C. for 30 minutes to thereby form a conductive layer having a film thickness of 15 μm.

Then, 3 parts of N-methoxymethylated nylon and 3 parts of copolymerized nylon were dissolved in a mixed solvent of 65 parts of methanol and 30 parts of n-butanol to thereby prepare an intermediate-layer coating solution.

The intermediate-layer coating solution was applied onto the conductive layer by dip coating and dried at 80° C. for 10 minutes to thereby form an intermediate layer having a film thickness of 0.7 μm.

Then, 10 parts of a hydroxygallium phthalocyanine crystal (charge generation substance) in the form of a crystal, having strong peaks at 7.5°, 9.9°, 16.3°, 18.6°, 25.1° and 28.3° of Bragg angles 2θ±0.2° in CuKα characteristic X-ray diffraction was used as a charge generation substance. This was added to a solution obtained by dissolving 5 parts of a polyvinylbutyral resin (trade name: S-LEC BX-1, produced by Sekisui Chemical Co., Ltd.) in 250 parts of cyclohexanone, and dispersed in the solution by a sand mill apparatus using glass beads of 1 mm in diameter under an atmosphere of 23±3° C. for 1 hour, and 250 parts of ethyl acetate was added thereto to thereby prepare a charge generation-layer coating solution.

The charge generation-layer coating solution was applied onto the intermediate layer by dip coating and dried at 100° C. for 10 minutes to thereby form a charge generation layer having a film thickness of 0.26 μm.

Then, 5.6 parts of a compound represented by the formula (CTM-1) (charge transport substance), 2.4 parts of a compound represented by the formula (CTM-2) (charge transport substance), 10 parts of a polycarbonate resin A(1) (resin A(1)) and 0.36 parts of a polycarbonate resin (D1) (resin (D1)), 2.5 parts of methyl benzoate, 20 parts of dimethoxymethane, and 30 parts of o-xylene were mixed to prepare a solution, which was used as an charge transport-layer coating solution.

The charge transport-layer coating solution was applied onto the charge generation layer by dip coating and dried at 125° C. for 30 minutes to thereby form a charge transport layer having a film thickness of 15 μm. The content of methyl benzoate in the formed charge transport layer was measured by using gas chromatography according to the measuring method to be found to be 0.028% by mass.

In this way, an electrophotographic photosensitive member in which the charge transport layer was the surface layer was produced.

Hereinafter, evaluations will be described.

The evaluations were performed for the variation in light area potential (potential variation) at the time of the repeating use and for the initial friction coefficient.

As an apparatus for evaluating the potential variation, HP Color Laser Jet Enterprise CP4525n manufactured by Hewlett-Packard Development Company, L.P. (process speed 240 mm/sec, to which a cylindrical electrophotographic photosensitive member of 24 mm in diameter could be mounted), which was altered so as to apply a DC bias to the electrophotographic photosensitive member by using an external supply, was used. The produced electrophotographic photosensitive member mounted to the process cartridge was placed on the station of the process cartridge, and evaluated in an environment of a temperature of 15° C. and a humidity of 10% RH.

<Evaluation of Potential Variation>

The surface potential of the electrophotographic photosensitive member (dark area potential and light area potential) was measured at the position of a developing unit by using the altered cartridge in which a jig secured so as to locate a probe for potential measurement at a position 131 mm (central portion) away from the edge of the electrophotographic photosensitive member was exchanged for the developing unit. A bias to be applied was set so that the dark area potential of the nonexposed portion of the electrophotographic photosensitive member was −500V, to measure the light area potential which had been subjected to light attenuation from the dark area potential by means of irradiation with laser light (0.37 $\mu J/cm^2$). Using plain paper of A4 size, an image was continuously output on 30,000 sheets of the paper, and the light area potential (light area potential after the repeating use) after such output was measured. In Example 1, the initial light area potential was −120 V, the light area potential after the repeating use was −270 V, and the variation in light area potential during the repeating use was 150 V. The electrophotographic photosensitive member containing no compound γ was used as an electrophotographic photosensitive member for control, and a value calculated by subtracting the amount of variation in the light area potential in the Example from the amount of variation in the light area potential of the electrophotographic photosensitive member for control was assumed as the amount of reduction in the variation in light area potential. In Example 1, the electrophotographic photosensitive member for control was assumed as the electrophotographic photosensitive member in the following Comparative Example 1.

<Measurement of Friction Coefficient>

The measurement of the friction coefficient of the electrophotographic photosensitive member produced in each of Examples and Comparative Examples was performed by the method described below. The measurement of the friction coefficient was performed by using HEIDON-14 manufactured by SHINTO Scientific Co., Ltd. under a normal temperature and normal humidity environment (23° C./50% RH). A blade (urethane rubber blade) to which a constant load was applied was placed in contact with the electrophotographic photosensitive member. A frictional force exerted between the electrophotographic photosensitive member and the rubber blade was measured when the electrophotographic photosensitive member was parallel translated at a scan speed of 50 mm/min. The frictional, force was measured as the amount of strain of a strain gauge attached at the side of the urethane rubber blade and converted into a tensile load (force to be applied to the photosensitive member). The coefficient of kinetic friction was obtained from [force to be applied to photosensitive member (frictional force) (gf)]/[load applied to blade (gf)] when the urethane rubber blade was operated. The urethane rubber blade used was a urethane blade (rubber hardness: 67°) manufactured by Hokushin Industry Inc., which was cut into a piece measuring 5 mm×30 mm×2 mm, and the friction coefficient was measured under a load of 50 g at an angle of 27° to the with direction of the electrophotographic photosensitive member. In Example 1, the friction coefficient was 0.15. The electrophotographic photosensitive member containing no compound γ was used as the electrophotographic photosensitive member for control, and a value calculated by subtracting the amount of variation in the light area potential in the Example from the amount of variation in the light area potential of the electrophotographic photosensitive member for control was assumed as the amount of reduction in the variation in the light area potential. In Example 1, the electrophotographic photosensitive member for control was assumed as the electrophotographic photosensitive member in the following Comparative Example 1.

Examples 2 to 6

Each electrophotographic photosensitive member was produced in the same manner as in Example 1 except that the type and content of the compound γ in Example 1 were changed to the type and content as shown in Table 4, and evaluated. The results are shown in Table 13. The electrophotographic photosensitive member in Comparative Example 1 was used for the electrophotographic photosensitive member for control, as in Example 1.

Example 7

An electrophotographic photosensitive member was produced in the same manner as in Example 1 except that the drying temperature and time during the formation of the charge transport layer in Example 1 were changed to 145° C. and 60 minutes, and evaluated. The results are shown in Table 13. The electrophotographic photosensitive member in Comparative Example 1 was used for the electrophotographic photosensitive member for control, as in Example 1.

Examples 8 and 9

Each electrophotographic photosensitive member was produced in the same manner as in Example 1 except that the film thickness of the charge transport layer in Example 1 was changed to 30 μm in Example 8 and changed to 10 μm in Example 9, and evaluated. The results are shown in Table 13. The electrophotographic photosensitive member in Comparative Example 1 was used for the electrophotographic photosensitive member for control, as in Example 1.

Examples 10 and 11

Each electrophotographic photosensitive member was produced in the same manner as in Example 1 except that the drying temperature and time during the formation of the charge transport layer and the film thickness of the charge transport layer in Example 1 were changed to 130° C., 60 minutes and 10 μm in Example 10, and changed to 120° C., 20 minutes and 10 μm in Example 9, and evaluated. The results are shown in Table 13. The electrophotographic photosensitive member in Comparative Example 1 was used for the electrophotographic photosensitive member for control, as in Example 1.

Examples 12 to 22 and 24 to 38

Each electrophotographic photosensitive member was produced in the same manner as in Example 1 except that the types and contents of the resin α, the resin β, the compound γ, the charge transport substance and the solvent in Example 1 were changed to the types and contents shown in Tables 4 and 5, and evaluated. The results are shown in Table 13. The film thicknesses of the charge transport layers in Examples 28 and 32 were 13 μm and 20 μm, respectively. The electrophotographic photosensitive member in Comparative Example 1 was used for the electrophotographic photosensitive member for control in each of Examples 14 to 22, 25, 28, 35 and 38. The electrophotographic photosensitive member in Comparative Example 6 was used for the electrophotographic photosensitive member for control in each of Examples 12 and 26. The electrophotographic photosensitive member in Comparative Example 7 was used for the electrophotographic photosensitive member for control in each of Examples 13 and 27. The electrophotographic photosensitive member in Comparative Example 9 was used for the electrophotographic photosensitive member for control in Example 29. The electrophotographic photosensitive member in Comparative Example 10 was used for the electrophotographic photosensitive member for control in each of Examples 30 to 34. The electrophotographic photosensitive member in Comparative Example 13 was used for the electrophotographic photosensitive member for control in Example 36. The electrophotographic photosensitive member in Comparative Example 14 was used for the electrophotographic photosensitive member for control in each of Examples 24 and 37.

TABLE 4

| | α | | β | | CTM | | γ | | First solvent/Second solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 1 | Resin A(1) | 10 | Resin D(1) | 0.36 | CTM-1/ CTM-2 | 5.6/2.4 | Methyl benzoate | 2.5 | o-Xylene/ Dimethoxymethane | 30/20 |
| 2 | Resin A(1) | 10 | Resin D(1) | 0.36 | CTM-1/ CTM-2 | 5.6/2.4 | Ethyl benzoate | 2.5 | o-Xylene/ Dimethoxymethane | 30/20 |
| 3 | Resin A(1) | 10 | Resin D(1) | 0.36 | CTM-1/ CTM-2 | 5.6/2.4 | Methyl benzoate/ Ethyl benzoate | 1.5/1 | o-Xylene/ Dimethoxymethane | 30/20 |
| 4 | Resin A(1) | 10 | Resin D(1) | 0.36 | CTM-1/ CTM-2 | 5.6/2.4 | Benzyl acetate | 2.5 | o-Xylene/ Dimethoxymethane | 30/20 |
| 5 | Resin A(1) | 10 | Resin D(1) | 0.36 | CTM-1/ CTM-2 | 5.6/2.4 | Ethyl 3-ethoxypropionate | 2.5 | o-Xylene/ Dimethoxymethane | 30/20 |
| 6 | Resin A(1) | 10 | Resin D(1) | 0.36 | CTM-1/ CTM-2 | 5.6/2.4 | Diethylene glycol ethyl methyl ether | 2.5 | o-Xylene/ Dimethoxymethane | 30/20 |
| 7 | Resin A(1) | 10 | Resin D(1) | 0.36 | CTM-1/ CTM-2 | 5.6/2.4 | Methyl benzoate | 2.5 | o-Xylene/ Dimethoxymethane | 28/20 |
| 8 | Resin A(1) | 10 | Resin D(1) | 0.36 | CTM-1/ CTM-2 | 5.6/2.4 | Methyl benzoate | 2.5 | o-Xylene/ Dimethoxymethane | 30/20 |
| 9 | Resin A(1) | 10 | Resin D(1) | 0.36 | CTM-1/ CTM-2 | 5.6/2.4 | Methyl benzoate | 2.5 | o-Xylene/ Dimethoxymethane | 30/20 |
| 10 | Resin A(1) | 10 | Resin D(1) | 0.36 | CTM-1/ CTM-2 | 5.6/2.4 | Methyl benzoate | 2.5 | o-Xylene/ Dimethoxymethane | 30/20 |
| 11 | Resin A(1) | 10 | Resin D(1) | 0.36 | CTM-1/ CTM-2 | 5.6/2.4 | Methyl benzoate | 2.5 | o-Xylene/ Dimethoxymethane | 30/20 |
| 12 | Resin A(1) | 10 | Resin D(1) | 0.01 | CTM-1/ CTM-2 | 5.6/2.4 | Methyl benzoate | 2.5 | o-Xylene/ Dimethoxymethane | 30/20 |
| 13 | Resin A(1) | 10 | Resin D(1) | 5 | CTM-1/ CTM-2 | 5.6/2.4 | Methyl benzoate | 2.5 | o-Xylene/ Dimethoxymethane | 30/20 |
| 14 | Resin A(1) | 10 | Resin D(1) | 0.36 | CTM-1/ CTM-2 | 5.6/2.4 | Methyl benzoate | 0.5 | o-Xylene/ Dimethoxymethane | 30/20 |
| 15 | Resin A(1) | 10 | Resin D(1) | 0.36 | CTM-1/ CTM-2 | 5.6/2.4 | Methyl benzoate | 8 | o-Xylene/ Dimethoxymethane | 28/20 |
| 16 | Resin A(1) | 10 | Resin D(1) | 0.36 | CTM-1/ CTM-2 | 5.6/2.4 | Methyl benzoate | 2.5 | Toluene/ Dimethoxymethane | 30/20 |
| 17 | Resin A(1) | 10 | Resin D(1) | 0.36 | CTM-1/ CTM-2 | 5.6/2.4 | Methyl benzoate | 2.5 | m-Xylene/ Dimethoxymethane | 30/20 |
| 18 | Resin A(1) | 10 | Resin D(1) | 0.36 | CTM-1/ CTM-2 | 5.6/2.4 | Methyl benzoate | 2.5 | p-Xylene/ Dimethoxymethane | 30/20 |
| 19 | Resin A(1) | 10 | Resin D(1) | 0.36 | CTM-1/ CTM-2 | 5.6/2.4 | Methyl benzoate | 2.5 | o-Xylene/ Toluene/ Dimethoxymethane | 15/15/ 20 |

TABLE 5

| | α | | β | | CTM | | γ | | First solvent/Second solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 20 | Resin A(1) | 10 | Resin D(1) | 0.36 | CTM-1/ CTM-2 | 5.6/2.4 | Methyl benzoate | 2.5 | Mixed xylene/ Dimethoxymethane | 30/20 |
| 21 | Resin A(1) | 10 | Resin D(1) | 0.36 | CTM-1/ CTM-2 | 5.6/2.4 | Methyl benzoate | 2.5 | Toluene/ THF | 30/20 |
| 22 | Resin A(1) | 10 | Resin D(1) | 0.36 | CTM-1/ CTM-2 | 5.6/2.4 | Methyl benzoate | 2.5 | o-Xylene | 50 |
| 24 | Resin A(1) | 10 | Resin D(2) | 0.36 | CTM-1/ CTM-2 | 5.6/2.4 | Methyl benzoate | 2.5 | o-Xylene/ Dimethoxymethane | 30/20 |
| 25 | Resin A(1) | 10 | Resin E(1) | 0.36 | CTM-1/ CTM-2 | 5.6/2.4 | Methyl benzoate | 2.5 | o-Xylene/ Dimethoxymethane | 30/20 |
| 26 | Resin A(1) | 10 | Resin D(1) | 0.01 | CTM-1/ CTM-2 | 5.6/2.4 | Methyl benzoate | 0.5 | o-Xylene/ Dimethoxymethane | 30/20 |
| 27 | Resin A(1) | 10 | Resin D(1) | 5 | CTM-1/ CTM-2 | 5.6/2.4 | Methyl benzoate | 0.5 | o-Xylene/ Dimethoxymethane | 30/20 |
| 28 | Resin A(1)/ Resin A(2) | 8/2 | Resin D(1) | 0.36 | CTM-1/ CTM-2 | 5.6/2.4 | Methyl benzoate | 2.5 | o-Xylene/ Dimethoxymethane | 30/20 |
| 29 | Resin A(1)/ Resin A(7) | 9/1 | Resin D(1) | 0.1 | CTM-1/ CTM-2 | 5.6/2.4 | Methyl benzoate | 2.5 | o-Xylene/ Dimethoxymethane | 30/20 |
| 30 | Resin A(3) | 10 | Resin D(1) | 0.36 | CTM-1/ CTM-2 | 5.6/2.4 | Methyl benzoate | 2.5 | o-Xylene/ Dimethoxymethane | 40/30 |
| 31 | Resin A(3) | 10 | Resin D(1) | 0.36 | CTM-1/ CTM-2 | 4/4 | Methyl benzoate | 2.5 | o-Xylene/ Dimethoxymethane | 40/30 |
| 32 | Resin A(3) | 10 | Resin D(1) | 0.36 | CTM-1/ CTM-3 | 7.2/0.8 | Methyl benzoate | 2.5 | o-Xylene/ Dimethoxymethane | 40/30 |
| 33 | Resin A(3)/ Resin A(8) | 9/1 | Resin D(1) | 0.1 | CTM-1/ CTM-2 | 5.6/2.4 | Methyl benzoate | 2.5 | o-Xylene/ Dimethoxymethane | 40/30 |
| 34 | Resin A(3)/ Resin A(8) | 9/1 | Resin D(1) | 0.1 | CTM-1/ CTM-3 | 7.2/0.8 | Methyl benzoate | 2.5 | o-Xylene/ Dimethoxymethane | 40/30 |
| 35 | Resin A(1) | 10 | Resin D(4) | 0.36 | CTM-1/ CTM-2 | 5.6/2.4 | Methyl benzoate | 2.5 | o-Xylene/ Dimethoxymethane | 30/20 |
| 36 | Resin A(4) | 10 | Resin D(1) | 0.36 | CTM-1/ CTM-2 | 5.6/2.4 | Methyl benzoate | 2.5 | o-Xylene/ Dimethoxymethane | 30/20 |
| 37 | Resin A(5) | 10 | Resin D(2) | 0.36 | CTM-1/ CTM-2 | 5.6/2.4 | Methyl benzoate | 2.5 | o-Xylene/ Dimethoxymethane | 30/20 |
| 38 | Resin A(1) | 10 | Resin D(3) | 0.36 | CTM-1/ CTM-2 | 5.6/2.4 | Methyl benzoate | 2.5 | o-Xylene/ Dimethoxymethane | 30/20 |
| 200 | Resin A(1) | 10 | Resin D(1) | 0.36 | CTM-1/ CTM-2 | 5.6/2.4 | Methyl benzoate | 18 | o-Xylene/ Dimethoxymethane | 12/20 |
| 201 | Resin A(3)/ Resin A(8) | 9/1 | Resin D(1) | 0.09 | CTM-1/ CTM-2 | 7.2/0.8 | Methyl benzoate | 14 | o-Xylene/ Dimethoxymethane | 21/35 |
| 203 | Resin B(1)/ Resin A(3)/ Resin A(8) | 5/4/1 | Resin D(1) | 0.095 | CTM-1/ CTM-3 | 8.1/0.9 | Methyl benzoate | 15 | o-Xylene/ Dimethoxymethane | 22.5/ 37.5 |

Comparative Examples 1 and 2

Each electrophotographic photosensitive member was produced in the same manner as in Example 1 except that the compound γ was not used and the type of the solvent was changed to the solvent shown in Table 6 in Example 1, and evaluated. The results are shown in Table 13. The electrophotographic photosensitive member in Comparative Example 1 was used for the electrophotographic photosensitive member for control in Comparative Example 2.

Comparative Examples 3 to 5

Each electrophotographic photosensitive member was produced in the same manner as in Example 1 except that the compound γ in Example 1 was changed to the Comparative Compound (monoglyme, diisobutyl ketone, n-pentyl acetate) of the compound γ, and evaluated. The results are shown in Table 13. The electrophotographic photosensitive member in Comparative Example 1 was used for the electrophotographic photosensitive member for control, as in Example 1.

Comparative Examples 6 to 15

Each electrophotographic photosensitive member was produced in the same manner as in Example 1 except that the types and contents of the resin α, the resin β, the compound γ (Comparative Compound), the charge transport substance and the solvent in Example 1 were changed to the types and contents shown in Table 6, and evaluated. The results are shown in Table 13. The electrophotographic photosensitive member in Comparative Example 1 was used for the electrophotographic photosensitive member for control in each of Comparative Examples 8 and 15, as in Example 1. The electrophotographic photosensitive member in Comparative Example 10 was used for the electrophotographic photosensitive member for control in Comparative Example 11.

TABLE 6

| Comparative Example | α Type of resin | α Parts by mass | β Type of resin | β Parts by mass | CTM Structure | CTM Parts by mass | γ/Comparative Compound Type | γ/Comparative Compound Parts by mass | First solvent/Second solvent Type | First solvent/Second solvent Parts by mass |
|---|---|---|---|---|---|---|---|---|---|---|
| 1 | Resin A(1) | 10 | Resin D(1) | 0.36 | CTM-1/ CTM-2 | 5.6/2.4 | — | — | o-Xylene/ Dimethoxymethane | 30/20 |
| 2 | Resin A(1) | 10 | Resin D(1) | 0.36 | CTM-1/ CTM-2 | 5.6/2.4 | — | — | Toluene/ THF | 30/20 |
| 3 | Resin A(1) | 10 | Resin D(1) | 0.36 | CTM-1/ CTM-2 | 5.6/2.4 | Monoglyme | 2.5 | o-Xylene/ Dimethoxymethane | 30/20 |
| 4 | Resin A(1) | 10 | Resin D(1) | 0.36 | CTM-1/ CTM-2 | 5.6/2.4 | Diisobutyl ketone | 2.5 | o-Xylene/ Dimethoxymethane | 30/20 |
| 5 | Resin A(1) | 10 | Resin D(1) | 0.36 | CTM-1/ CTM-2 | 5.6/2.4 | n-Pentyl acetate | 2.5 | o-Xylene/ Dimethoxymethane | 30/20 |
| 6 | Resin A(1) | 10 | Resin D(1) | 0.01 | CTM-1/ CTM-2 | 5.6/2.4 | — | — | o-Xylene/ Dimethoxymethane | 30/20 |
| 7 | Resin A(1) | 10 | Resin D(1) | 5 | CTM-1/ CTM-2 | 5.6/2.4 | — | — | o-Xylene/ Dimethoxymethane | 30/20 |
| 8 | Resin A(1)/ Resin A(2) | 8/2 | Resin D(1) | 0.36 | CTM-1/ CTM-2 | 5.6/2.4 | — | — | o-Xylene/ Dimethoxymethane | 30/20 |
| 9 | Resin A(1)/ Resin A(7) | 9/1 | Resin D(1) | 0.1 | CTM-1/ CTM-2 | 5.6/2.4 | — | — | o-Xylene/ Dimethoxymethane | 30/20 |
| 10 | Resin A(3) | 10 | Resin D(1) | 0.36 | CTM-1/ CTM-2 | 5.6/2.4 | — | — | o-Xylene/ Dimethoxymethane | 40/30 |
| 11 | Resin A(3)/ Resin A(8) | 9/1 | Resin D(1) | 0.1 | CTM-1/ CTM-3 | 7.2/0.8 | — | — | o-Xylene/ Dimethoxymethane | 40/30 |
| 12 | Resin A(1) | 10 | Resin D(4) | 0.36 | CTM-1/ CTM-2 | 5.6/2.4 | — | — | o-Xylene/ Dimethoxymethane | 30/20 |
| 13 | Resin A(4) | 10 | Resin D(1) | 0.36 | CTM-1/ CTM-2 | 5.6/2.4 | — | — | o-Xylene/ Dimethoxymethane | 30/20 |
| 14 | Resin A(5) | 10 | Resin D(2) | 0.36 | CTM-1/ CTM-2 | 5.6/2.4 | — | — | o-Xylene/ Dimethoxymethane | 30/20 |
| 15 | Resin A(1) | 10 | Resin D(3) | 0.36 | CTM-1/ CTM-2 | 5.6/2.4 | — | — | o-Xylene/ Dimethoxymethane | 30/20 |

Examples 39 to 51 and 53 to 75

Each electrophotographic photosensitive member was produced in the same manner as in Example 1 except that the types and contents of the constituent elements: the resin α, the resin β, the compound γ, the charge transport substance and the solvent in Example 1 were changed to the types and contents shown in Tables 7 and 8, and evaluated. The results are shown in Table 14. The film thicknesses of the charge transport layers in Examples 28 and 32 were 13 μm and 20 μm, respectively. The electrophotographic photosensitive member in Comparative Example 16 was used for the electrophotographic photosensitive member for control in each of Examples 39 to 45, 48 to 51, 53 and 54. The electrophotographic photosensitive member in Comparative Example 22 was used for the electrophotographic photosensitive member for control in each of Examples 46 and 55. The electrophotographic photosensitive member in Comparative Example 23 was used for the electrophotographic photosensitive member for control in each of Examples 47, 56, 64 and 68. The electrophotographic photosensitive member in Comparative Example 24 was used for the electrophotographic photosensitive member for control in each of Examples 57 to 63, 65 to 67 and 69 to 70. The electrophotographic photosensitive member in Comparative Example 25 was used for the electrophotographic photosensitive member for control in each of Examples 71 to 75.

Example 76

An electrophotographic photosensitive member was produced in the same manner as in Example 1 except that the additive in Example 1 was changed to an additive containing 0.8 parts of a compound represented by the following formula (AD-1) and 0.2 parts of a compound represented by the following formula (AD-2), and the types and contents of the constituent elements: the resin α, the resin β, the compound γ and the charge transport substance in Example 1 were changed to the types and contents shown in Table 8, and evaluated. The results are shown in Table 14. The electrophotographic photosensitive member in Comparative Example 31 was used for the electrophotographic photosensitive member for control.

(AD-1)

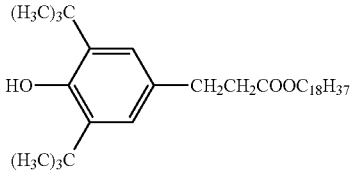

(AD-2)

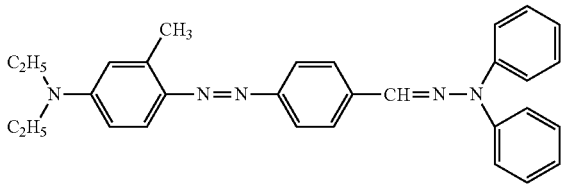

TABLE 7

| | α | | β | | CTM | | γ | | First solvent/Second solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 39 | Resin B(1) | 10 | Resin D(1) | 0.36 | CTM-1/ CTM-2 | 5.6/2.4 | Methyl benzoate | 2.5 | o-Xylene/ Dimethoxymethane | 45/30 |
| 40 | Resin B(1) | 10 | Resin D(1) | 0.36 | CTM-1/ CTM-2 | 8.1/0.9 | Methyl benzoate | 2.5 | o-Xylene/ Dimethoxymethane | 45/30 |
| 41 | Resin B(1) | 10 | Resin D(1) | 0.36 | CTM-1/ CTM-2 | 5.6/2.4 | Ethyl benzoate | 2.5 | o-Xylene/ Dimethoxymethane | 45/30 |
| 42 | Resin B(1) | 10 | Resin D(1) | 0.36 | CTM-1/ CTM-2 | 5.6/2.4 | Methyl benzoate/ Ethyl benzoate | 1.5/1 | o-Xylene/ Dimethoxymethane | 45/30 |
| 43 | Resin B(1) | 10 | Resin D(1) | 0.36 | CTM-1/ CTM-2 | 5.6/2.4 | Benzyl acetate | 2.5 | o-Xylene/ Dimethoxymethane | 45/30 |
| 44 | Resin B(1) | 10 | Resin D(1) | 0.36 | CTM-1/ CTM-2 | 5.6/2.4 | Ethyl 3-ethoxypropionate | 2.5 | o-Xylene/ Dimethoxymethane | 45/30 |
| 45 | Resin B(1) | 10 | Resin D(1) | 0.36 | CTM-1/ CTM-2 | 5.6/2.4 | Diethylene glycol ethyl methyl ether | 2.5 | o-Xylene/ Dimethoxymethane | 45/30 |
| 46 | Resin B(1) | 10 | Resin D(1) | 0.01 | CTM-1/ CTM-2 | 5.6/2.4 | Methyl benzoate | 2.5 | o-Xylene/ Dimethoxymethane | 45/30 |
| 47 | Resin B(1) | 10 | Resin D(1) | 5 | CTM-1/ CTM-2 | 5.6/2.4 | Methyl benzoate | 2.5 | o-Xylene/ Dimethoxymethane | 45/30 |
| 48 | Resin B(1) | 10 | Resin D(1) | 0.36 | CTM-1/ CTM-2 | 5.6/2.4 | Methyl benzoate | 0.5 | o-Xylene/ Dimethoxymethane | 45/30 |
| 49 | Resin B(1) | 10 | Resin D(1) | 0.36 | CTM-1/ CTM-2 | 5.6/2.4 | Methyl benzoate | 8 | o-Xylene/ Dimethoxymethane | 40/27 |
| 50 | Resin B(1) | 10 | Resin D(1) | 0.36 | CTM-1/ CTM-2 | 5.6/2.4 | Methyl benzoate | 2.5 | Toluene/ Dimethoxymethane | 45/30 |
| 51 | Resin B(1) | 10 | Resin D(1) | 0.36 | CTM-1/ CTM-2 | 5.6/2.4 | Methyl benzoate | 2.5 | Toluene/ THF | 45/30 |
| 53 | Resin B(1) | 10 | Resin D(2) | 0.36 | CTM-1/ CTM-2 | 5.6/2.4 | Methyl benzoate | 2.5 | o-Xylene/ Dimethoxymethane | 45/30 |
| 54 | Resin B(1) | 10 | Resin E(1) | 0.36 | CTM-1/ CTM-2 | 5.6/2.4 | Methyl benzoate | 2.5 | o-Xylene/ Dimethoxymethane | 45/30 |
| 55 | Resin B(1) | 10 | Resin D(1) | 0.01 | CTM-1/ CTM-2 | 5.6/2.4 | Methyl benzoate | 0.5 | o-Xylene/ Dimethoxymethane | 45/30 |
| 56 | Resin B(1) | 10 | Resin D(1) | 5 | CTM-1/ CTM-2 | 5.6/2.4 | Methyl benzoate | 0.5 | o-Xylene/ Dimethoxymethane | 45/30 |
| 57 | Resin B(2) | 10 | Resin D(1) | 0.36 | CTM-1/ CTM-2 | 5.6/2.4 | Methyl benzoate | 2.5 | o-Xylene/ Dimethoxymethane | 60/40 |
| 58 | Resin B(2) | 10 | Resin D(1) | 0.36 | CTM-1/ CTM-2 | 5.6/2.4 | Ethyl benzoate | 2.5 | o-Xylene/ Dimethoxymethane | 60/40 |
| 59 | Resin B(2) | 10 | Resin D(1) | 0.36 | CTM-1/ CTM-2 | 5.6/2.4 | Methyl benzoate/ Ethyl benzoate | 1.5/1 | o-Xylene/ Dimethoxymethane | 60/40 |

TABLE 8

| | α | | β | | CTM | | γ | | First solvent/Second solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 60 | Resin B(2) | 10 | Resin D(1) | 0.36 | CTM-1/ CTM-2 | 5.6/2.4 | Benzyl acetate | 2.5 | o-Xylene/ Dimethoxymethane | 60/40 |
| 61 | Resin B(2) | 10 | Resin D(1) | 0.36 | CTM-1/ CTM-2 | 5.6/2.4 | Ethyl 3-ethoxypropionate | 2.5 | o-Xylene/ Dimethoxymethane | 60/40 |
| 62 | Resin B(2) | 10 | Resin D(1) | 0.36 | CTM-1/ CTM-2 | 5.6/2.4 | Diethylene glycol ethyl methyl ether | 2.5 | o-Xylene/ Dimethoxymethane | 60/40 |
| 63 | Resin B(2) | 10 | Resin D(1) | 0.01 | CTM-1/ CTM-2 | 5.6/2.4 | Methyl benzoate | 2.5 | o-Xylene/ Dimethoxymethane | 60/40 |
| 64 | Resin B(2) | 10 | Resin D(1) | 5 | CTM-1/ CTM-2 | 5.6/2.4 | Methyl benzoate | 2.5 | o-Xylene/ Dimethoxymethane | 60/40 |
| 65 | Resin B(2) | 10 | Resin D(1) | 0.36 | CTM-1/ CTM-2 | 5.6/2.4 | Methyl benzoate | 0.5 | o-Xylene/ Dimethoxymethane | 60/40 |
| 66 | Resin B(2) | 10 | Resin D(1) | 0.36 | CTM-1/ CTM-2 | 5.6/2.4 | Methyl benzoate | 8 | o-Xylene/ Dimethoxymethane | 56/38 |
| 67 | Resin B(2) | 10 | Resin D(1) | 0.01 | CTM-1/ CTM-2 | 5.6/2.4 | Methyl benzoate | 0.5 | o-Xylene/ Dimethoxymethane | 60/40 |
| 68 | Resin B(2) | 10 | Resin D(1) | 5 | CTM-1/ CTM-2 | 5.6/2.4 | Methyl benzoate | 0.5 | o-Xylene/ Dimethoxymethane | 60/40 |
| 69 | Resin B(2) | 10 | Resin D(1) | 0.36 | CTM-1/ CTM-2 | 5.6/2.4 | Methyl benzoate | 2.5 | Toluene/ Dimethoxymethane | 60/40 |
| 70 | Resin B(2) | 10 | Resin D(1) | 0.36 | CTM-1/ CTM-2 | 5.6/2.4 | Methyl benzoate | 2.5 | Toluene/ THF | 60/40 |
| 71 | Resin B(3) | 10 | Resin D(1) | 0.36 | CTM-1/ CTM-2 | 5.6/2.4 | Ethyl benzoate | 2.5 | o-Xylene/ Dimethoxymethane | 60/40 |

TABLE 8-continued

| | α | | β | | CTM | | γ | | First solvent/Second solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 72 | Resin B(3) | 10 | Resin D(1) | 0.36 | CTM-1/ CTM-2 | 5.6/2.4 | Methyl benzoate/ Ethyl benzoate | 1.5/1 | o-Xylene/ Dimethoxymethane | 60/40 |
| 73 | Resin B(3) | 10 | Resin D(1) | 0.36 | CTM-1/ CTM-2 | 5.6/2.4 | Benzyl acetate | 2.5 | o-Xylene/ Dimethoxymethane | 60/40 |
| 74 | Resin B(3) | 10 | Resin D(1) | 0.36 | CTM-1/ CTM-2 | 5.6/2.4 | Ethyl 3-ethoxypropionate | 2.5 | o-Xylene/ Dimethoxymethane | 60/40 |
| 75 | Resin B(3) | 10 | Resin D(1) | 0.36 | CTM-1/ CTM-2 | 5.6/2.4 | Diethylene glycol ethyl methyl ether | 2.5 | o-Xylene/ Dimethoxymethane | 60/40 |
| 76 | Resin B(3)/ Resin A(6) | 7/3 | Resin D(1) | 0.36 | CTM-6/ CTM-7 | 5/2.5 | Methyl benzoate | 2.5 | Toluene/THF | 10/40 |
| 202 | Resin B(1) | 10 | Resin D(1) | 0.36 | CTM-1/ CTM-2 | 5.6/2.4 | Methyl benzoate | 27 | o-Xylene/ Dimethoxymethane | 18/30 |

Comparative Examples 16 to 30

Each electrophotographic photosensitive member was produced in the same manner as in Example 1 except that the types and contents of the constituent elements: the resin α, the resin β, the compound γ (Comparative Compound), the charge transport substance and the solvent; in Example 1 were changed to the types and contents shown in Table 9, and evaluated. The results are shown in Table 14. The electrophotographic photosensitive member in Comparative Example 16 was used for the electrophotographic photosensitive member for control in each of Comparative Examples 17 to 21 and 29 to 30. The electrophotographic photosensitive member in Comparative Example 25 was used for the electrophotographic photosensitive member for control in each of Comparative Examples 26 to 28.

Comparative Example 31

An electrophotographic photosensitive member was produced in the same manner as in Example 1 except that the compound γ was not contained in Example 76, and evaluated. The results are shown in Table 14.

Comparative Examples 32 and 33

Each electrophotographic photosensitive member was produced in the same manner as in Example 1 except that the resin β was changed to dimethylsilicone oil (KF-96-100cs, produced by Shin-Etsu Chemical Cop, Ltd.) as shown in Table 9 and the resin α, the resin β and the compound γ were changed as shown Table 9, in Example 1, and evaluated. The results are shown in Table 14. The electrophotographic photosensitive member in Comparative Example 33 was used for the electrophotographic photosensitive member for control in Comparative Example 32.

TABLE 9

| Comparative | α | | β | | CTM | | γ/Comparative Compound | | First solvent/Second solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 16 | Resin B(1) | 10 | Resin D(1) | 0.36 | CTM-1/ CTM-2 | 5.6/2.4 | — | — | o-Xylene/ Dimethoxymethane | 45/30 |
| 17 | Resin B(1) | 10 | Resin D(1) | 0.36 | CTM-1/ CTM-2 | 5.6/2.4 | — | — | Toluene/ THF | 45/30 |
| 18 | Resin B(1) | 10 | Resin D(1) | 0.36 | CTM-1/ CTM-2 | 5.6/2.4 | — | — | o-Xylene | 70 |
| 19 | Resin B(1) | 10 | Resin D(1) | 0.36 | CTM-1/ CTM-2 | 5.6/2.4 | Monoglyme | 2.5 | o-Xylene/ Dimethoxymethane | 45/30 |
| 20 | Resin B(1) | 10 | Resin D(1) | 0.36 | CTM-1/ CTM-2 | 5.6/2.4 | Diisobutyl ketone | 2.5 | o-Xylene/ Dimethoxymethane | 45/30 |
| 21 | Resin B(1) | 10 | Resin D(1) | 0.36 | CTM-1/ CTM-2 | 5.6/2.4 | n-Pentyl acetate | 2.5 | o-Xylene/ Dimethoxymethane | 45/30 |
| 22 | Resin B(1) | 10 | Resin D(1) | 0.01 | CTM-1/ CTM-2 | 5.6/2.4 | — | — | o-Xylene/ Dimethoxymethane | 45/30 |
| 23 | Resin B(1) | 10 | Resin D(1) | 5 | CTM-1/ CTM-2 | 5.6/2.4 | — | — | o-Xylene/ Dimethoxymethane | 45/30 |
| 24 | Resin B(2) | 10 | Resin D(1) | 0.36 | CTM-1/ CTM-2 | 5.6/2.4 | — | — | o-Xylene/ Dimethoxymethane | 60/40 |
| 25 | Resin B(3) | 10 | Resin D(1) | 0.36 | CTM-1/ CTM-2 | 5.6/2.4 | — | — | o-Xylene/ Dimethoxymethane | 60/40 |
| 26 | Resin B(3) | 10 | Resin D(1) | 0.36 | CTM-1/ CTM-2 | 5.6/2.4 | Monoglyme | 2.5 | o-Xylene/ Dimethoxymethane | 60/40 |
| 27 | Resin B(3) | 10 | Resin D(1) | 0.36 | CTM-1/ CTM-2 | 5.6/2.4 | Diisobutyl ketone | 2.5 | o-Xylene/ Dimethoxymethane | 60/40 |
| 28 | Resin B(3) | 10 | Resin D(1) | 0.36 | CTM-1/ CTM-2 | 5.6/2.4 | n-Pentyl acetate | 2.5 | o-Xylene/ Dimethoxymethane | 60/40 |

TABLE 9-continued

| Comparative | α | | β | | CTM | | γ/Comparative Compound | | First solvent/Second solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 29 | Resin B(1) | 10 | Resin D(2) | 0.36 | CTM-1/ CTM-2 | 5.6/2.4 | — | — | o-Xylene/ Dimethoxymethane | 60/40 |
| 30 | Resin B(1) | 10 | Resin E(1) | 0.36 | CTM-1/ CTM-2 | 5.6/2.4 | — | — | o-Xylene/ Dimethoxymethane | 60/40 |
| 31 | Resin B(3)/ Resin A(6) | 7/3 | Resin D(1) | 0.36 | CTM-6/ CTM-7 | 5/2.5 | — | — | Toluene/THF | 10/40 |
| 32 | Resin A(1) | 10 | KF-96-CSS | 0.36 | CTM-1/ CTM-2 | 5.6/2.4 | Methyl benzoate | 2.5 | o-Xylene/ Dimethoxymethane | 30/20 |
| 33 | Resin A(1) | 10 | KF-96-CSS | 0.36 | CTM-1/ CTM-2 | 5.6/2.4 | — | — | o-Xylene/ Dimethoxymethane | 30/20 |

Examples 77 to 100

Each electrophotographic photosensitive member was produced in the same manner as in Example 1 except that the types and contents of the resin α, the resin β, the compound γ, the charge transport substance and the solvent in Example 1 were changed to the types and contents shown in Table 10, and evaluated. The results are shown in Table 15. The film thickness of the charge transport layer in each of Examples 78, 95, 96 and 100 was 25 μm. The electrophotographic photosensitive member in Comparative Example 34 was used for the electrophotographic photosensitive member for control in each of Examples 77 to 83 and 86 to 91. The electrophotographic photosensitive member in Comparative Example 38 was used for the electrophotographic photosensitive member for control in each of Examples 84 and 92. The electrophotographic photosensitive member in Comparative Example 39 was used for the electrophotographic photosensitive member for control in Example 85. The electrophotographic photosensitive member in Comparative Example 40 was used for the electrophotographic photosensitive member for control in each of Examples 94 to 98. The electrophotographic photosensitive member in Comparative Example 42 was used for the electrophotographic photosensitive member for control in each of Examples 99 and 100.

Examples 101 to 115 and 117 to 146

Each electrophotographic photosensitive member was produced in the same manner as in Example 1 except that the types and contents of the resin α, the resin β, the compound γ, the charge transport substance and the solvent in Example 1 were changed to the types and contents shown in Tables 10 and 11, and evaluated. The results are shown in Table 16. The film thickness of the charge transport layer in each of Examples 119, 121, and 123 to 125 was 25 μm. The electrophotographic photosensitive member in Comparative Example 43 was used for the electrophotographic photosensitive member for control in each of Examples 101 to 107, 110, 111, 114, 115 and 117. The electrophotographic photosensitive member in Comparative Example 49 was used for the electrophotographic photosensitive member for control in each of Examples 108 and 112. The electrophotographic photosensitive member in Comparative Example 50 was used for the electrophotographic photosensitive member for control in each of Examples 109, 113, 132 and 136. The electrophotographic photosensitive member in Comparative Example 51 was used for the electrophotographic photosensitive member for control in each of Examples 118 and 119. The electrophotographic photosensitive member in Comparative Example 52 was used for the electrophotographic photosensitive member for control in each of Examples 120 and 121. The electrophotographic photosensitive member in Comparative Example 53 was used for the electrophotographic photosensitive member for control in each of Examples 122 and 123. The electrophotographic photosensitive member in Comparative Example 54 was used for the electrophotographic photosensitive member for control in each of Examples 124 to 131, 133 to 135, and 137 to 138. The electrophotographic photosensitive member in Comparative Example 60 was used for the electrophotographic photosensitive member for control in each of Examples 139 to 146.

Examples 200 to 207

Each electrophotographic photosensitive member was produced in the same manner as in Example 1 except that the types and contents of the resin α, the resin β, the compound γ, the charge transport substance and the solvent in Example 1 were changed to the types and contents shown in Tables 5, 8, 10 and 12, and evaluated. The results are shown in Tables 14 to 17. The electrophotographic photosensitive member in Comparative Example 1 was used for the electrophotographic photosensitive member for control in Example 200. The electrophotographic photosensitive member in Comparative Example 10 was used for the electrophotographic photosensitive member for control in each of Examples 201 and 203. The electrophotographic photosensitive member in Comparative Example 16 was used for the electrophotographic photosensitive member for control in Example 202. The electrophotographic photosensitive member in Comparative Example 34 was used for the electrophotographic photosensitive member for control in each of Examples 204 and 205. The electrophotographic photosensitive member in Comparative Example 43 was used for the electrophotographic photosensitive member for control in Example 206. The electrophotographic photosensitive member in Comparative Example 54 was used for the electrophotographic photosensitive member for control in Example 207.

TABLE 10

| | α | | β | | CTM | | γ | | First solvent/Second solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 77 | Resin A(1) | 10 | F-B | 0.18 | CTM-1/ CTM-2 | 5.6/2.4 | Methyl benzoate | 2.5 | o-Xylene/ Dimethoxymethane | 30/20 |
| 78 | Resin A(1) | 10 | F-B | 0.1 | CTM-5 | 9.5 | Methyl benzoate | 2.5 | o-Xylene/ Dimethoxymethane | 30/20 |
| 79 | Resin A(1) | 10 | F-B | 0.18 | CTM-1/ CTM-2 | 5.6/2.4 | Ethyl benzoate | 2.5 | o-Xylene/ Dimethoxymethane | 30/20 |
| 80 | Resin A(1) | 10 | F-B | 0.18 | CTM-1/ CTM-2 | 5.6/2.4 | Methyl benzoate/ Ethyl benzoate | 1.5/1 | o-Xylene/ Dimethoxymethane | 30/20 |
| 81 | Resin A(1) | 10 | F-B | 0.18 | CTM-1/ CTM-2 | 5.6/2.4 | Benzyl acetate | 2.5 | o-Xylene/ Dimethoxymethane | 30/20 |
| 82 | Resin A(1) | 10 | F-B | 0.18 | CTM-1/ CTM-2 | 5.6/2.4 | Ethyl 3-ethoxypropionate | 2.5 | o-Xylene/ Dimethoxymethane | 30/20 |
| 83 | Resin A(1) | 10 | F-B | 0.18 | CTM-1/ CTM-2 | 5.6/2.4 | Diethylene glycol ethyl methyl ether | 2.5 | o-Xylene/ Dimethoxymethane | 30/20 |
| 84 | Resin A(1) | 10 | F-B | 0.01 | CTM-1/ CTM-2 | 5.6/2.4 | Methyl benzoate | 2.5 | o-Xylene/ Dimethoxymethane | 30/20 |
| 85 | Resin A(1) | 10 | F-B | 5 | CTM-1/ CTM-2 | 5.6/2.4 | Methyl benzoate | 2.5 | o-Xylene/ Dimethoxymethane | 30/20 |
| 86 | Resin A(1) | 10 | F-B | 0.18 | CTM-1/ CTM-2 | 5.6/2.4 | Methyl benzoate | 0.5 | o-Xylene/ Dimethoxymethane | 30/20 |
| 87 | Resin A(1) | 10 | F-B | 0.18 | CTM-1/ CTM-2 | 5.6/2.4 | Methyl benzoate | 8 | o-Xylene/ Dimethoxymethane | 28/18 |
| 88 | Resin A(1) | 10 | F-B | 0.18 | CTM-1/ CTM-2 | 5.6/2.4 | Methyl benzoate | 2.5 | Toluene/ Dimethoxymethane | 30/20 |
| 89 | Resin A(1) | 10 | F-B | 0.18 | CTM-1/ CTM-2 | 5.6/2.4 | Methyl benzoate | 2.5 | Toluene/ THF | 30/20 |
| 90 | Resin A(1) | 10 | F-B | 0.18 | CTM-1/ CTM-2 | 5.6/2.4 | Methyl benzoate | 2.5 | o-Xylene/ Dimethoxymethane | 20/30 |
| 91 | Resin A(1) | 10 | F-E | 0.18 | CTM-1/ CTM-2 | 5.6/2.4 | Methyl benzoate | 2.5 | o-Xylene/ Dimethoxymethane | 30/20 |
| 92 | Resin A(1) | 10 | F-B | 0.01 | CTM-1/ CTM-2 | 5.6/2.4 | Methyl benzoate | 0.5 | o-Xylene/ Dimethoxymethane | 30/20 |
| 94 | Resin A(1)/ Resin A(7) | 9.5/ 0.5 | F-B | 0.18 | CTM-1/ CTM-2 | 5.6/2.4 | Methyl benzoate | 2.5 | o-Xylene/ Dimethoxymethane | 30/20 |
| 95 | Resin A(1)/ Resin A(7) | 9.5/ 0.5 | F-B | 0.18 | CTM-1/ CTM-3 | 7.2/0.8 | Methyl benzoate | 2.5 | o-Xylene/ Dimethoxymethane | 30/20 |
| 96 | Resin A(1)/ Resin A(7) | 9.5/ 0.5 | F-B | 0.18 | CTM-1/ CTM-4 | 5.6/2.4 | Methyl benzoate | 2.5 | o-Xylene/ Dimethoxymethane | 30/20 |
| 97 | Resin A(1)/ Resin A(7)/ Resin A(9) | 8.5/ 0.5/1 | F-B | 0.18 | CTM-1/ CTM-2 | 5.6/2.4 | Methyl benzoate | 2.5 | o-Xylene/ Dimethoxymethane | 30/20 |
| 98 | Resin A(1)/ Resin A(7)/ Resin A(9) | 8.5/ 0.5/1 | F-B | 0.18 | CTM-1/ CTM-3 | 7.2/0.8 | Methyl benzoate | 2.5 | o-Xylene/ Dimethoxymethane | 30/20 |
| 99 | Resin A(3)/ Resin A(8)/ Resin A(9) | 8.5/ 0.5/1 | F-B | 0.18 | CTM-1/ CTM-2 | 5.6/2.4 | Methyl benzoate | 2.5 | o-Xylene/ Dimethoxymethane | 40/30 |
| 100 | Resin A(3)/ Resin A(8)/ Resin A(9) | 8.5/ 0.5/1 | F-B | 0.18 | CTM-1/ CTM-3 | 7.2/0.8 | Methyl benzoate | 2.5 | o-Xylene/ Dimethoxymethane | 40/30 |
| 204 | Resin A(1) | 10 | F-B | 0.18 | CTM-1/ CTM-2 | 5.6/2.4 | Methyl benzoate | 18 | o-Xylene/ Dimethoxymethane | 12/20 |
| 205 | Resin A(3) | 10 | F-B | 0.19 | CTM-1/ CTM-3 | 8.1/0.9 | Methyl benzoate | 15 | o-Xylene/ Dimethoxymethane | 23/38 |

TABLE 11

| | α | | β | | CTM | | γ | | First solvent/Second solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 101 | Resin B(1) | 10 | F-B | 0.18 | CTM-1/ CTM-2 | 5.6/2.4 | Methyl benzoate | 2.5 | o-Xylene/ Dimethoxymethane | 45/30 |
| 102 | Resin B(1) | 10 | F-B | 0.18 | CTM-1/ CTM-3 | 8.1/0.9 | Methyl benzoate | 2.5 | o-Xylene/ Dimethoxymethane | 45/30 |
| 103 | Resin B(1) | 10 | F-B | 0.18 | CTM-1/ CTM-2 | 5.6/2.4 | Ethyl benzoate | 2.5 | o-Xylene/ Dimethoxymethane | 45/30 |
| 104 | Resin B(1) | 10 | F-B | 0.18 | CTM-1/ CTM-2 | 5.6/2.4 | Methyl benzoate/ Ethyl benzoate | 1.5/1 | o-Xylene/ Dimethoxymethane | 45/30 |
| 105 | Resin B(1) | 10 | F-B | 0.18 | CTM-1/ CTM-2 | 5.6/2.4 | Benzyl acetate | 2.5 | o-Xylene/ Dimethoxymethane | 45/30 |

TABLE 11-continued

| | α | | β | | CTM | | γ | | First solvent/Second solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 106 | Resin B(1) | 10 | F-B | 0.18 | CTM-1/ CTM-2 | 5.6/2.4 | Ethyl 3-ethoxypropionate | 2.5 | o-Xylene/ Dimethoxymethane | 45/30 |
| 107 | Resin B(1) | 10 | F-B | 0.18 | CTM-1/ CTM-2 | 5.6/2.4 | Diethylene glycol ethyl methyl ether | 2.5 | o-Xylene/ Dimethoxymethane | 45/30 |
| 108 | Resin B(1) | 10 | F-B | 0.01 | CTM-1/ CTM-2 | 5.6/2.4 | Methyl benzoate | 2.5 | o-Xylene/ Dimethoxymethane | 45/30 |
| 109 | Resin B(1) | 10 | F-B | 5 | CTM-1/ CTM-2 | 5.6/2.4 | Methyl benzoate | 2.5 | o-Xylene/ Dimethoxymethane | 45/30 |
| 110 | Resin B(1) | 10 | F-B | 0.18 | CTM-1/ CTM-2 | 5.6/2.4 | Methyl benzoate | 0.5 | o-Xylene/ Dimethoxymethane | 45/30 |
| 111 | Resin B(1) | 10 | F-B | 0.18 | CTM-1/ CTM-2 | 5.6/2.4 | Methyl benzoate | 8 | o-Xylene/ Dimethoxymethane | 40/27 |
| 112 | Resin B(1) | 10 | F-B | 0.01 | CTM-1/ CTM-2 | 5.6/2.4 | Methyl benzoate | 0.5 | o-Xylene/ Dimethoxymethane | 45/30 |
| 113 | Resin B(1) | 10 | F-B | 5 | CTM-1/ CTM-2 | 5.6/2.4 | Methyl benzoate | 0.5 | o-Xylene/ Dimethoxymethane | 45/30 |
| 114 | Resin B(1) | 10 | F-B | 0.18 | CTM-1/ CTM-2 | 5.6/2.4 | Methyl benzoate | 2.5 | Toluene/ Dimethoxymethane | 45/30 |
| 115 | Resin B(1) | 10 | F-B | 0.18 | CTM-1/ CTM-2 | 5.6/2.4 | Methyl benzoate | 2.5 | Toluene/ THF | 45/30 |
| 117 | Resin B(1) | 10 | F-E | 0.18 | CTM-1/ CTM-3 | 5.6/2.4 | Methyl benzoate | 2.5 | o-Xylene/ Dimethoxymethane | 45/30 |
| 118 | Resin B(1)/ Resin A(9) | 9.5/ 0.5 | F-B | 0.18 | CTM-1/ CTM-2 | 5.6/2.4 | Methyl benzoate | 2.5 | o-Xylene/ Dimethoxymethane | 45/30 |
| 119 | Resin B(1)/ Resin A(9) | 9.5/ 0.5 | F-B | 0.18 | CTM-1/ CTM-3 | 7.2/0.8 | Methyl benzoate | 2.5 | o-Xylene/ Dimethoxymethane | 45/30 |
| 120 | Resin B(1)/ Resin A(1)/ Resin A(8) | 5/4/1 | F-B | 0.18 | CTM-1/ CTM-2 | 5.6/2.4 | Methyl benzoate | 2.5 | o-Xylene/ Dimethoxymethane | 45/30 |
| 121 | Resin B(1)/ Resin A(1)/ Resin A(8) | 5/4/1 | F-B | 0.18 | CTM-1/ CTM-3 | 8.1/0.9 | Methyl benzoate | 2.5 | o-Xylene/ Dimethoxymethane | 45/30 |
| 122 | Resin B(1)/ Resin A(3)/ Resin A(8) | 5/4/1 | F-B | 0.18 | CTM-1/ CTM-2 | 5.6/2.4 | Methyl benzoate | 2.5 | o-Xylene/ Dimethoxymethane | 45/30 |
| 123 | Resin B(1)/ Resin A(3)/ Resin A(8) | 5/4/1 | F-B | 0.18 | CTM-1/ CTM-3 | 8.1/0.9 | Methyl benzoate | 2.5 | o-Xylene/ Dimethoxymethane | 45/30 |
| 124 | Resin B(2) | 10 | F-B | 0.18 | CTM-1/ CTM-2 | 5.6/2.4 | Methyl benzoate | 2.5 | o-Xylene/ Dimethoxymethane | 60/40 |
| 125 | Resin B(2) | 10 | F-B | 0.18 | CTM-1/ CTM-3 | 7.2/0.8 | Methyl benzoate | 2.5 | o-Xylene/ Dimethoxymethane | 60/40 |
| 126 | Resin B(2) | 10 | F-B | 0.18 | CTM-1/ CTM-2 | 5.6/2.4 | Ethyl benzoate | 2.5 | o-Xylene/ Dimethoxymethane | 60/40 |

Comparative Example 34

An electrophotographic photosensitive member was produced in the same manner as in Example 1 except that the compound γ was not used in Example 72, and evaluated. The results are shown in Table 15.

Comparative Examples 35 to 37

Each electrophotographic photosensitive member was produced in the same manner as in Example 1 except that the compound γ in Examples 72 was changed to the Comparative Compound (monoglyme, diisobutyl ketone, n-pentyl acetate) of the compound γ, and evaluated. The results are shown in Table 15. The electrophotographic photosensitive member in Comparative Example 34 was used for the electrophotographic photosensitive member for control in Comparative Examples 35 to 37.

Comparative Examples 38 to 42

Each electrophotographic photosensitive member was produced in the same manner as in Example 1 except that the types and contents of the resin α, the resin β, the compound γ (Comparative Compound), the charge transport substance and the solvent in Example 1 were changed to the types and contents shown in Table 12, and evaluated. The results are shown in Table 15. The electrophotographic photosensitive member in Comparative Example 40 was used for the electrophotographic photosensitive member for control in Comparative Example 41.

Comparative Examples 43 to 60

Each electrophotographic photosensitive member was produced in the same manner as in Example 1 except that the types and contents of the resin α, the resin β, the compound γ (Comparative Compound), the charge transport substance and the solvent in Example 1 were changed to the types and contents shown in Table 12, and evaluated. The results are shown in Table 16. The electrophotographic photosensitive member in Comparative Example 43 was used for the electrophotographic photosensitive member for control in each of Comparative Examples 44 to 48. The electrophotographic photosensitive member in Comparative Example 54 was used for the electrophotographic photosensitive member for control in each of Comparative Examples 55 to 59.

TABLE 12

| | α | | β | | CTM | | γ | | First solvent/Second solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 127 | Resin B(2) | 10 | F-B | 0.18 | CTM-1/ CTM-2 | 5.6/2.4 | Methyl benzoate/ Ethyl benzoate | 1.5/1 | o-Xylene/ Dimethoxymethane | 60/40 |
| 128 | Resin B(2) | 10 | F-B | 0.18 | CTM-1/ CTM-2 | 5.6/2.4 | Benzyl acetate | 2.5 | o-Xylene/ Dimethoxymethane | 60/40 |
| 129 | Resin B(2) | 10 | F-B | 0.18 | CTM-1/ CTM-2 | 5.6/2.4 | Ethyl 3-ethoxypropionate | 2.5 | o-Xylene/ Dimethoxymethane | 60/40 |
| 130 | Resin B(2) | 10 | F-B | 0.18 | CTM-1/ CTM-2 | 5.6/2.4 | Diethylene glycol ethyl methyl ether | 2.5 | o-Xylene/ Dimethoxymethane | 60/40 |
| 131 | Resin B(2) | 10 | F-B | 0.01 | CTM-1/ CTM-2 | 5.6/2.4 | Methyl benzoate | 2.5 | o-Xylene/ Dimethoxymethane | 60/40 |
| 132 | Resin B(2) | 10 | F-B | 5 | CTM-1/ CTM-2 | 5.6/2.4 | Methyl benzoate | 2.5 | o-Xylene/ Dimethoxymethane | 60/40 |
| 133 | Resin B(2) | 10 | F-B | 0.18 | CTM-1/ CTM-2 | 5.6/2.4 | Methyl benzoate | 0.5 | o-Xylene/ Dimethoxymethane | 60/40 |
| 134 | Resin B(2) | 10 | F-B | 0.18 | CTM-1/ CTM-2 | 5.6/2.4 | Methyl benzoate | 8 | o-Xylene/ Dimethoxymethane | 56/38 |
| 135 | Resin B(2) | 10 | F-B | 0.01 | CTM-1/ CTM-2 | 5.6/2.4 | Methyl benzoate | 0.5 | o-Xylene/ Dimethoxymethane | 60/40 |
| 136 | Resin B(2) | 10 | F-B | 5 | CTM-1/ CTM-2 | 5.6/2.4 | Methyl benzoate | 0.5 | o-Xylene/ Dimethoxymethane | 60/40 |
| 137 | Resin B(2) | 10 | F-B | 0.18 | CTM-1/ CTM-2 | 5.6/2.4 | Methyl benzoate | 2.5 | Toluene/ Dimethoxymethane | 60/40 |
| 138 | Resin B(2) | 10 | F-B | 0.18 | CTM-1/ CTM-2 | 5.6/2.4 | Methyl benzoate | 2.5 | o-Xylene/ Dimethoxymethane | 60/40 |
| 139 | Resin B(3) | 10 | F-B | 0.18 | CTM-1/ CTM-2 | 5.6/2.4 | Methyl benzoate | 2.5 | o-Xylene/ Dimethoxymethane | 60/40 |
| 140 | Resin B(3) | 10 | F-B | 0.18 | CTM-1/ CTM-2 | 5.6/2.4 | Methyl benzoate | 2.5 | Toluene/ THF | 60/40 |
| 141 | Resin B(3) | 10 | F-B | 0.18 | CTM-1/ CTM-2 | 5.6/2.4 | Methyl benzoate | 2.5 | Toluene/ Dimethoxymethane | 60/40 |
| 142 | Resin B(3) | 10 | F-B | 0.18 | CTM-1/ CTM-2 | 5.6/2.4 | Ethyl benzoate | 2.5 | o-Xylene/ Dimethoxymethane | 60/40 |
| 143 | Resin B(3) | 10 | F-B | 0.18 | CTM-1/ CTM-2 | 5.6/2.4 | Methyl benzoate Ethyl benzoate | 2.5 | o-Xylene/ Dimethoxymethane | 60/40 |
| 144 | Resin B(3) | 10 | F-B | 0.18 | CTM-1/ CTM-2 | 5.6/2.4 | Benzyl acetate | 2.5 | o-Xylene/ Dimethoxymethane | 60/40 |
| 145 | Resin B(3) | 10 | F-B | 0.18 | CTM-1/ CTM-2 | 5.6/2.4 | Ethyl 3-ethoxypropionate | 2.5 | o-Xylene/ Dimethoxymethane | 60/40 |
| 146 | Resin B(3) | 10 | F-B | 0.18 | CTM-1/ CTM-2 | 5.6/2.4 | Diethylene glycol ethyl methyl ether | 2.5 | o-Xylene/ Dimethoxymethane | 60/40 |
| 206 | Resin B(1) | 10 | F-B | 0.18 | CTM-1/ CTM-2 | 5.6/2.4 | Methyl benzoate | 27 | o-Xylene/ Dimethoxymethane | 18/30 |
| 207 | Resin B(2) | 10 | F-B | 0.18 | CTM-1/ CTM-3 | 7.2/0.8 | Methyl benzoate | 30 | o-Xylene/ Dimethoxymethane | 20/50 |

TABLE 13

| | α | | β | | CTM | | γ/Comparative Compound | | First solvent/Second solvent | |
|---|---|---|---|---|---|---|---|---|---|---|
| Comparative Example | Type of resin | Parts by mass | Type of resin | Parts by mass | Structure | Parts by mass | Type | Parts by mass | Type | Parts by mass |
| 34 | Resin A(1) | 10 | F-B | 0.18 | CTM-1/ CTM-2 | 5.6/2.4 | — | — | o-Xylene/ Dimethoxymethane | 30/20 |
| 35 | Resin A(1) | 10 | F-B | 0.18 | CTM-1/ CTM-2 | 5.6/2.4 | Monoglyme | 2.5 | o-Xylene/ Dimethoxymethane | 30/20 |
| 36 | Resin A(1) | 10 | F-B | 0.18 | CTM-1/ CTM-2 | 5.6/2.4 | Diisobutyl ketone | 2.5 | o-Xylene/ Dimethoxymethane | o-Xylene/ |
| 37 | Resin A(1) | 10 | F-B | 0.18 | CTM-1/ CTM-2 | 5.6/2.4 | n-Pentyl acetate | 2.5 | o-Xylene/ Dimethoxymethane | 30/20 |
| 38 | Resin A(1) | 10 | F-B | 0.01 | CTM-1/ CTM-2 | 5.6/2.4 | — | — | o-Xylene/ Dimethoxymethane | 30/20 |
| 39 | Resin A(1) | 10 | F-B | 5 | CTM-1/ CTM-2 | 5.6/2.4 | — | — | o-Xylene/ Dimethoxymethane | 30/20 |
| 40 | Resin A(1)/ Resin A(7) | 9.5/0.5 | F-B | 0.18 | CTM-1/ CTM-2 | 5.6/2.4 | — | — | o-Xylene/ Dimethoxymethane | 30/20 |
| 41 | Resin A(1)/ Resin A(7)/ Resin A(9) | 8.5/0.5/1 | F-B | 0.18 | CTM-1/ CTM-2 | 5.6/2.4 | — | — | o-Xylene/ Dimethoxymethane | 30/20 |

TABLE 13-continued

| | α | | β | | CTM | | γ/Comparative Compound | | First solvent/Second solvent | |
|---|---|---|---|---|---|---|---|---|---|---|
| Comparative Example | Type of resin | Parts by mass | Type of resin | Parts by mass | Structure | Parts by mass | Type | Parts by mass | Type | Parts by mass |
| 42 | Resin A(3)/ Resin A(8)/ Resin A(9) | 8.5/0.5/1 | F-B | 0.18 | CTM-1/ CTM-3 | 7.2/0.8 | — | — | o-Xylene/ Dimethoxymethane | 40/30 |
| 43 | Resin B(1) | 10 | F-B | 0.18 | CTM-1/ CTM-2 | 5.6/2.4 | — | — | o-Xylene/ Dimethoxymethane | 45/30 |
| 44 | Resin B(1) | 10 | F-B | 0.18 | CTM-1/ CTM-2 | 5.6/2.4 | — | — | Toluene/ THF | 45/30 |
| 45 | Resin B(1) | 10 | F-B | 0.18 | CTM-1/ CTM-2 | 5.6/2.4 | — | — | o-Xylene | 70 |
| 46 | Resin B(1) | 10 | F-B | 0.18 | CTM-1/ CTM-2 | 5.6/2.4 | Monoglyme | 2.5 | o-Xylene/ Dimethoxymethane | 45/30 |
| 47 | Resin B(1) | 10 | F-B | 0.18 | CTM-1/ CTM-2 | 5.6/2.4 | Diisobutyl ketone | 2.5 | o-Xylene/ Dimethoxymethane | 45/30 |
| 48 | Resin B(1) | 10 | F-B | 0.18 | CTM-1/ CTM-2 | 5.6/2.4 | n-Pentyl acetate | 2.5 | o-Xylene/ Dimethoxymethane | 45/30 |
| 49 | Resin B(1) | 10 | F-B | 0.01 | CTM-1/ CTM-2 | 5.6/2.4 | — | — | o-Xylene/ Dimethoxymethane | 45/30 |
| 50 | Resin B(1) | 10 | F-B | 5 | CTM-1/ CTM-2 | 5.6/2.4 | — | — | o-Xylene/ Dimethoxymethane | 45/30 |
| 51 | Resin B(1)/ Resin A(9) | 9.5/0.5 | F-B | 0.18 | CTM-1/ CTM-3 | 7.2/0.8 | — | — | o-Xylene/ Dimethoxymethane | 45/30 |
| 52 | Resin B(1)/ Resin A(1)/ Resin A(8) | 5/4/1 | F-B | 0.18 | CTM-1/ CTM-3 | 8.1/0.9 | — | — | o-Xylene/ Dimethoxymethane | 45/30 |
| 53 | Resin B(1)/ Resin A(3)/ Resin A(8) | 5/4/1 | F-B | 0.18 | CTM-1/ CTM-3 | 8.1/0.9 | — | — | o-Xylene/ Dimethoxymethane | 45/30 |
| 54 | Resin B(2) | 10 | F-B | 0.18 | CTM-1/ CTM-2 | 5.6/2.4 | — | — | o-Xylene/ Dimethoxymethane | 60/40 |
| 55 | Resin B(2) | 10 | F-B | 0.18 | CTM-1/ CTM-2 | 5.6/2.4 | — | — | Toluene/ THF | 60/40 |
| 56 | Resin B(2) | 10 | F-B | 0.18 | CTM-1/ CTM-2 | 5.6/2.4 | — | — | o-Xylene | 90 |
| 57 | Resin B(2) | 10 | F-B | 0.18 | CTM-1/ CTM-2 | 5.6/2.4 | Monoglyme | 2.5 | o-Xylene/ Dimethoxymethane | 60/40 |
| 58 | Resin B(2) | 10 | F-B | 0.18 | CTM-1/ CTM-2 | 5.6/2.4 | Diisobutyl ketone | 2.5 | o-Xylene/ Dimethoxymethane | 60/40 |
| 59 | Resin B(2) | 10 | F-B | 0.18 | CTM-1/ CTM-2 | 5.6/2.4 | n-Pentyl acetate | 2.5 | o-Xylene/ Dimethoxymethane | 60/40 |
| 60 | Resin B(3) | 10 | F-B | 0.18 | CTM-1/ CTM-2 | 5.6/2.4 | — | — | o-Xylene/ Dimethoxymethane | 60/40 |

TABLE 14

| Example/ Comparative Example | Amount of (γ) in surface layer (% by mass) | Initial light area Potential (V) | Light area potential after 30,000 sheets (V) | Amount of variation in light area potential (ΔV) | Amount of reduction in variation in light area potential | Coefficient of kinetic friction | Control Comparative Example |
|---|---|---|---|---|---|---|---|
| Example 1 | 0.028 | 120 | 270 | 150 | 30 | 0.38 (0.15) | 1 |
| Example 2 | 0.029 | 120 | 272 | 152 | 28 | 0.38 (0.15) | 1 |
| Example 3 | 0.031 | 120 | 274 | 154 | 26 | 0.38 (0.15) | 1 |
| Example 4 | 0.033 | 125 | 280 | 155 | 25 | 0.40 (0.16) | 1 |
| Example 5 | 0.035 | 120 | 270 | 150 | 30 | 0.45 (0.18) | 1 |
| Example 6 | 0.028 | 120 | 275 | 155 | 25 | 0.48 (0.19) | 1 |
| Example 7 | 0.001 | 130 | 280 | 150 | 30 | 0.38 (0.15) | 1 |
| Example 8 | 0.050 | 120 | 270 | 150 | 30 | 0.50 (0.2) | 1 |
| Example 9 | 0.015 | 120 | 270 | 150 | 30 | 0.40 (0.16) | 1 |
| Example 10 | 0.001 | 120 | 275 | 150 | 30 | 0.55 (0.22) | 1 |
| Example 11 | 0.480 | 120 | 280 | 150 | 30 | 0.68 (0.27) | 1 |
| Example 12 | 0.030 | 120 | 250 | 130 | 20 | 0.38 (0.31) | 6 |

TABLE 14-continued

| Example/ Comparative Example | Amount of (γ) in surface layer (% by mass) | Initial light area Potential (V) | Light area potential after 30,000 sheets (V) | Amount of variation in light area potential (ΔV) | Amount of reduction in variation in light area potential | Coefficient of kinetic friction | Control Comparative Example |
|---|---|---|---|---|---|---|---|
| Example 13 | 0.031 | 120 | 280 | 160 | 30 | 0.39 (0.15) | 7 |
| Example 14 | 0.012 | 120 | 270 | 150 | 30 | 0.68 (0.27) | 1 |
| Example 15 | 0.120 | 125 | 275 | 150 | 30 | 0.45 (0.18) | 1 |
| Example 16 | 0.025 | 120 | 270 | 150 | 30 | 0.40 (0.16) | 1 |
| Example 17 | 0.020 | 120 | 270 | 150 | 30 | 0.40 (0.16) | 1 |
| Example 18 | 0.025 | 125 | 275 | 150 | 30 | 0.43 (0.17) | 1 |
| Example 19 | 0.025 | 125 | 275 | 150 | 30 | 0.40 (0.16) | 1 |
| Example 20 | 0.025 | 125 | 275 | 150 | 30 | 0.38 (0.15) | 1 |
| Example 21 | 0.025 | 120 | 268 | 148 | 32 | 0.45 (0.18) | 1 |
| Example 22 | 0.025 | 120 | 273 | 153 | 27 | 0.45 (0.18) | 1 |
| Example 23 | 0.025 | 125 | 270 | 145 | 35 | 0.53 (0.21) | 1 |
| Example 24 | 0.025 | 145 | 325 | 180 | 5 | 0.49 (0.2) | 14 |
| Example 25 | 0.025 | 130 | 300 | 170 | 10 | 0.58 (0.23) | 1 |
| Example 26 | 0.001 | 120 | 250 | 130 | 20 | 0.43 (0.35) | 6 |
| Example 27 | 0.001 | 120 | 280 | 160 | 30 | 0.68 (0.26) | 7 |
| Example 28 | 0.018 | 120 | 265 | 145 | 35 | 0.40 (0.16) | 1 |
| Example 29 | 0.022 | 120 | 265 | 145 | 30 | 0.45 (0.2) | 9 |
| Example 30 | 0.026 | 90 | 235 | 145 | 15 | 0.40 (0.18) | 10 |
| Example 31 | 0.032 | 95 | 225 | 130 | 30 | 0.40 (0.18) | 10 |
| Example 32 | 0.040 | 95 | 230 | 135 | 25 | 0.42 (0.19) | 10 |
| Example 33 | 0.030 | 90 | 230 | 140 | 20 | 0.51 (0.23) | 10 |
| Example 34 | 0.026 | 90 | 220 | 130 | 30 | 0.53 (0.24) | 10 |
| Example 35 | 0.028 | 125 | 255 | 130 | 50 | 0.80 (0.32) | 1 |
| Example 36 | 0.029 | 115 | 255 | 140 | 45 | 0.48 (0.2) | 13 |
| Example 37 | 0.028 | 120 | 265 | 145 | 40 | 0.49 (0.2) | 14 |
| Example 38 | 0.03 | 120 | 270 | 150 | 30 | 0.38 (0.15) | 1 |
| Example 200 | 0.86 | 120 | 270 | 150 | 30 | 0.38 (0.15) | 1 |
| Example 201 | 0.75 | 90 | 220 | 130 | 30 | 0.42 (0.19) | 10 |
| Example 203 | 0.77 | 130 | 270 | 140 | 20 | 0.38 (0.17) | 10 |
| Comparative Example 1 | — | 120 | 300 | 180 | | — (0.4) | |
| Comparative Example 2 | — | 120 | 305 | 185 | −5 | 1.05 (0.42) | 1 |
| Comparative Example 3 | — | 120 | 295 | 175 | 5 | 1.00 (0.4) | 1 |
| Comparative Example 4 | — | 125 | 310 | 185 | −5 | 1.05 (0.42) | 1 |
| Comparative Example 5 | — | 125 | 310 | 185 | −5 | 1.03 (0.41) | 1 |
| Comparative Example 6 | — | 120 | 270 | 150 | | — (0.82) | |
| Comparative Example 7 | — | 120 | 310 | 190 | | — (0.38) | |
| Comparative Example 8 | — | 120 | 295 | 175 | 5 | 0.98 (0.39) | 1 |
| Comparative Example 9 | — | 120 | 295 | 175 | | — (0.44) | |
| Comparative Example 10 | — | 85 | 245 | 160 | | — (0.45) | |
| Comparative Example 11 | — | 90 | 245 | 155 | 5 | 0.96 (0.43) | 10 |
| Comparative Example 13 | — | 120 | 305 | 185 | | — (0.42) | |
| Comparative Example 14 | — | 120 | 305 | 185 | | — (0.41) | |
| Comparative Example 15 | — | 125 | 300 | 175 | 5 | 0.98 (0.39) | 1 |

TABLE 15

| Example/ Comparative Example | Amount of (γ) in surface layer (% by mass) | Initial light area Potential (V) | Light area potential after 30,000 sheets (V) | Amount of variation in light area potential (ΔV) | Amount of reduction in variation in light area potential | Coefficient of kinetic friction | Control Comparative Example |
|---|---|---|---|---|---|---|---|
| Example 39 | 0.028 | 90 | 220 | 130 | 10 | 0.33 (0.12) | 16 |
| Example 40 | 0.033 | 90 | 215 | 125 | 15 | 0.33 (0.12) | 16 |
| Example 41 | 0.026 | 95 | 220 | 125 | 15 | 0.33 (0.12) | 16 |
| Example 42 | 0.029 | 90 | 225 | 135 | 5 | 0.33 (0.12) | 16 |

TABLE 15-continued

| Example/ Comparative Example | Amount of (γ) in surface layer (% by mass) | Initial light area Potential (V) | Light area potential after 30,000 sheets (V) | Amount of variation in light area potential (ΔV) | Amount of reduction in variation in light area potential | Coefficient of kinetic friction | Control Comparative Example |
|---|---|---|---|---|---|---|---|
| Example 43 | 0.033 | 100 | 230 | 130 | 10 | 0.36 (0.13) | 16 |
| Example 44 | 0.034 | 105 | 235 | 130 | 10 | 0.33 (0.12) | 16 |
| Example 45 | 0.033 | 95 | 225 | 130 | 10 | 0.36 (0.13) | 16 |
| Example 46 | 0.028 | 95 | 205 | 110 | 15 | 0.46 (0.21) | 22 |
| Example 47 | 0.033 | 95 | 245 | 150 | 30 | 0.50 (0.16) | 23 |
| Example 48 | 0.003 | 95 | 225 | 130 | 10 | 0.50 (0.18) | 16 |
| Example 49 | 0.95 | 90 | 225 | 135 | 5 | 0.44 (0.16) | 16 |
| Example 50 | 0.028 | 90 | 210 | 120 | 20 | 0.36 (0.13) | 16 |
| Example 51 | 0.028 | 95 | 225 | 130 | 10 | 0.44 (0.16) | 16 |
| Example 52 | 0.030 | 105 | 235 | 130 | 10 | 0.50 (0.18) | 16 |
| Example 53 | 0.027 | 120 | 245 | 125 | 15 | 0.50 (0.18) | 16 |
| Example 54 | 0.024 | 110 | 240 | 130 | 10 | 0.50 (0.18) | 16 |
| Example 55 | 0.026 | 85 | 205 | 120 | 5 | 0.41 (0.19) | 22 |
| Example 56 | 0.028 | 120 | 245 | 125 | 55 | 0.56 (0.18) | 23 |
| Example 57 | 0.029 | 100 | 235 | 135 | 30 | 0.46 (0.19) | 24 |
| Example 58 | 0.028 | 100 | 245 | 145 | 20 | 0.43 (0.15) | 24 |
| Example 59 | 0.029 | 100 | 245 | 145 | 20 | 0.46 (0.16) | 24 |
| Example 60 | 0.034 | 95 | 240 | 145 | 20 | 0.46 (0.16) | 24 |
| Example 61 | 0.035 | 100 | 240 | 140 | 25 | 0.43 (0.15) | 24 |
| Example 62 | 0.033 | 100 | 235 | 135 | 30 | 0.49 (0.17) | 24 |
| Example 63 | 0.000 | 95 | 220 | 125 | 40 | 0.71 (0.25) | 24 |
| Example 64 | 0.026 | 115 | 290 | 175 | 5 | 0.44 (0.14) | 23 |
| Example 65 | 0.004 | 100 | 245 | 145 | 20 | 0.63 (0.22) | 24 |
| Example 66 | 1.118 | 100 | 240 | 140 | 25 | 0.49 (0.17) | 24 |
| Example 67 | 0.025 | 90 | 215 | 125 | 40 | 0.69 (0.24) | 24 |
| Example 68 | 0.030 | 105 | 270 | 165 | 15 | 0.56 (0.18) | 23 |
| Example 69 | 0.029 | 95 | 235 | 140 | 25 | 0.43 (0.15) | 24 |
| Example 70 | 0.026 | 100 | 240 | 140 | 25 | 0.49 (0.17) | 24 |
| Example 71 | 0.033 | 100 | 240 | 140 | 10 | 0.56 (0.19) | 25 |
| Example 72 | 0.026 | 100 | 240 | 140 | 10 | 0.53 (0.18) | 25 |
| Example 73 | 0.031 | 105 | 240 | 135 | 15 | 0.53 (0.18) | 25 |
| Example 74 | 0.026 | 110 | 245 | 135 | 15 | 0.56 (0.19) | 25 |
| Example 75 | 0.029 | 100 | 240 | 140 | 10 | 0.56 (0.19) | 25 |
| Example 76 | 0.029 | 130 | 290 | 160 | 20 | 0.40 (0.18) | 31 |
| Example 202 | 0.92 | 90 | 215 | 125 | 15 | 0.33 (0.12) | 16 |
| Comparative Example 16 | — | 85 | 225 | 140 | | — (0.36) | |
| Comparative Example 17 | — | 85 | 230 | 145 | −5 | 1.08 (0.39) | 16 |
| Comparative Example 18 | — | 90 | 245 | 155 | −15 | 1.14 (0.41) | 16 |
| Comparative Example 19 | — | 90 | 230 | 140 | 0 | 1.11 (0.40) | 16 |
| Comparative Example 20 | — | 90 | 235 | 145 | −5 | 1.08 (0.39) | 16 |
| Comparative Example 21 | — | 90 | 245 | 155 | −15 | 1.06 (0.38) | 16 |
| Comparative Example 22 | — | 90 | 215 | 125 | | — (0.46) | |
| Comparative Example 23 | — | 90 | 270 | 180 | | — (0.32) | |
| Comparative Example 24 | — | 100 | 265 | 165 | | — (0.35) | |
| Comparative Example 25 | — | 115 | 265 | 150 | | — (0.34) | |
| Comparative Example 26 | — | 110 | 265 | 155 | −5 | 1.06 (0.36) | 25 |
| Comparative Example 27 | — | 110 | 260 | 150 | 0 | 0.94 (0.32) | 25 |
| Comparative Example 28 | — | 115 | 275 | 160 | −10 | 1.00 (0.34) | 25 |
| Comparative Example 29 | — | 90 | 260 | 170 | −30 | 1.17 (0.42) | 16 |
| Comparative Example 30 | — | 95 | 275 | 180 | −40 | 1.25 (0.45) | 16 |
| Comparative Example 31 | — | 130 | 310 | 180 | | — (0.45) | |
| Comparative Example 32 | — | 105 | 245 | 140 | 0 | 0.96 (0.43) | 33 |
| Comparative Example 33 | — | 105 | 245 | 140 | | — (0.45) | |

TABLE 16

| Example/ Comparative Example | Amount of (γ) in surface layer (% by mass) | Initial light area potential (V) | Light area Potential After 30,000 sheets (V) | Amount of variation in light area potential (ΔV) | Amount of reduction in variation in light area potential | Coefficient of kinetic friction | Control Comparative Example |
|---|---|---|---|---|---|---|---|
| Example 77 | 0.028 | 95 | 230 | 135 | 20 | 0.63 (0.42) | 34 |
| Example 78 | 0.033 | 100 | 240 | 140 | 15 | 0.64 (0.43) | 34 |
| Example 79 | 0.035 | 90 | 225 | 135 | 20 | 0.64 (0.43) | 34 |
| Example 80 | 0.040 | 90 | 225 | 135 | 20 | 0.61 (0.41) | 34 |
| Example 81 | 0.022 | 90 | 225 | 135 | 20 | 0.67 (0.45) | 34 |
| Example 82 | 0.029 | 95 | 230 | 135 | 20 | 0.69 (0.46) | 34 |
| Example 83 | 0.032 | 90 | 225 | 135 | 20 | 0.76 (0.51) | 34 |
| Example 84 | 0.035 | 85 | 210 | 125 | 15 | 0.67 (0.58) | 38 |
| Example 85 | 0.033 | 100 | 255 | 155 | 15 | 0.72 (0.43) | 39 |
| Example 86 | 0.012 | 90 | 225 | 135 | 20 | 0.84 (0.56) | 34 |
| Example 87 | 0.110 | 105 | 240 | 135 | 20 | 0.64 (0.43) | 34 |
| Example 88 | 0.026 | 90 | 225 | 135 | 20 | 0.69 (0.46) | 34 |
| Example 89 | 0.060 | 90 | 220 | 130 | 25 | 0.78 (0.52) | 34 |
| Example 90 | 0.030 | 85 | 215 | 130 | 25 | 0.79 (0.53) | 34 |
| Example 91 | 0.032 | 90 | 220 | 130 | 25 | 0.69 (0.46) | 34 |
| Example 92 | 0.029 | 90 | 215 | 125 | 15 | 0.71 (0.62) | 38 |
| Example 94 | 0.030 | 95 | 225 | 130 | 30 | 0.65 (0.36) | 40 |
| Example 95 | 0.250 | 95 | 225 | 130 | 30 | 0.62 (0.34) | 40 |
| Example 96 | 0.280 | 90 | 220 | 130 | 30 | 0.67 (0.37) | 40 |
| Example 97 | 0.030 | 95 | 230 | 135 | 25 | 0.58 (0.32) | 40 |
| Example 98 | 0.350 | 90 | 230 | 140 | 20 | 0.58 (0.32) | 40 |
| Example 99 | 0.028 | 95 | 225 | 130 | 30 | 0.40 (0.16) | 42 |
| Example 100 | 0.100 | 90 | 225 | 135 | 25 | 0.40 (0.16) | 42 |
| Example 204 | 0.81 | 95 | 230 | 135 | 20 | 0.40 (0.4) | 34 |
| Example 205 | 0.76 | 90 | 220 | 130 | 25 | 0.54 (0.36) | 34 |
| Comparative Example 34 | — | 100 | 255 | 155 | | — (0.67) | |
| Comparative Example 35 | — | 100 | 260 | 160 | −5 | 1.01 (0.68) | 34 |
| Comparative Example 36 | — | 100 | 250 | 150 | 5 | 0.96 (0.64) | 34 |
| Comparative Example 37 | — | 105 | 260 | 155 | 0 | 0.93 (0.62) | 34 |
| Comparative Example 38 | — | 110 | 250 | 140 | | — (0.87) | |
| Comparative Example 39 | — | 110 | 280 | 170 | | — (0.6) | |
| Comparative Example 40 | — | 100 | 260 | 160 | | — (0.55) | |
| Comparative Example 41 | — | 105 | 265 | 160 | 0 | 0.96 (0.53) | 40 |
| Comparative Example 42 | — | 95 | 255 | 160 | | — (0.4) | |

TABLE 17

| Example/ Comparative Example | Amount of (γ) in surface layer (% by mass) | Initial light Area Potential (V) | Light area potential l after 30,000 sheets (V) | Amount of variation n in light area potential (ΔV) | Amount of reduction in variation in light area potential | Coefficient of kinetic friction | Control Comparative Example |
|---|---|---|---|---|---|---|---|
| Example 101 | 0.030 | 85 | 205 | 120 | 20 | 0.61 (0.38) | 43 |
| Example 102 | 0.028 | 90 | 205 | 115 | 25 | 0.63 (0.39) | 43 |
| Example 103 | 0.026 | 105 | 225 | 120 | 20 | 0.66 (0.41) | 43 |
| Example 104 | 0.023 | 100 | 215 | 115 | 25 | 0.66 (0.41) | 43 |
| Example 105 | 0.027 | 110 | 230 | 120 | 20 | 0.69 (0.43) | 43 |
| Example 106 | 0.029 | 105 | 225 | 120 | 20 | 0.61 (0.38) | 43 |
| Example 107 | 0.028 | 90 | 215 | 125 | 15 | 0.65 (0.4) | 43 |
| Example 108 | 0.030 | 95 | 195 | 100 | 20 | 0.54 (0.48) | 49 |
| Example 109 | 0.030 | 100 | 250 | 150 | 40 | 0.64 (0.35) | 50 |
| Example 110 | 0.005 | 90 | 210 | 120 | 20 | 0.68 (0.42) | 43 |
| Example 111 | 1.300 | 90 | 210 | 120 | 20 | 0.61 (0.38) | 43 |
| Example 112 | 0.028 | 95 | 195 | 100 | 20 | 0.51 (0.45) | 49 |
| Example 113 | 0.030 | 105 | 255 | 150 | 40 | 0.78 (0.43) | 50 |
| Example 114 | 0.030 | 90 | 210 | 120 | 20 | 0.66 (0.41) | 43 |
| Example 115 | 0.029 | 90 | 210 | 120 | 20 | 0.68 (0.42) | 43 |
| Example 116 | 0.031 | 90 | 210 | 120 | 20 | 0.73 (0.45) | 43 |
| Example 117 | 0.033 | 90 | 210 | 120 | 20 | 0.66 (0.41) | 43 |
| Example 118 | 0.026 | 90 | 215 | 125 | 25 | 0.62 (0.33) | 51 |

TABLE 17-continued

| Example/ Comparative Example | Amount of (γ) in surface layer (% by mass) | Initial light Area Potential (V) | Light area potential l after 30,000 sheets (V) | Amount of variation n in light area potential (ΔV) | Amount of reduction in variation in light area potential | Coefficient of kinetic friction | Control Comparative Example |
|---|---|---|---|---|---|---|---|
| Example 119 | 0.024 | 90 | 225 | 135 | 15 | 0.60 (0.32) | 51 |
| Example 120 | 0.028 | 90 | 215 | 125 | 10 | 0.64 (0.34) | 52 |
| Example 121 | 0.042 | 90 | 210 | 120 | 15 | 0.60 (0.32) | 52 |
| Example 122 | 0.028 | 90 | 215 | 125 | 30 | 0.63 (0.33) | 53 |
| Example 123 | 0.060 | 90 | 220 | 130 | 25 | 0.62 (0.32) | 53 |
| Example 124 | 0.031 | 95 | 230 | 135 | 10 | 0.74 (0.45) | 54 |
| Example 125 | 0.029 | 95 | 225 | 130 | 15 | 0.70 (0.43) | 54 |
| Example 126 | 0.028 | 95 | 235 | 140 | 5 | 0.70 (0.43) | 54 |
| Example 127 | 0.026 | 95 | 230 | 135 | 10 | 0.69 (0.42) | 54 |
| Example 128 | 0.028 | 95 | 230 | 135 | 10 | 0.75 (0.46) | 54 |
| Example 129 | 0.024 | 95 | 235 | 140 | 5 | 0.74 (0.45) | 54 |
| Example 130 | 0.034 | 100 | 235 | 135 | 10 | 0.70 (0.43) | 54 |
| Example 131 | 0.033 | 85 | 205 | 120 | 25 | 0.84 (0.51) | 54 |
| Example 132 | 0.028 | 105 | 255 | 150 | 40 | 0.76 (0.42) | 50 |
| Example 133 | 0.007 | 95 | 230 | 135 | 10 | 0.87 (0.53) | 54 |
| Example 134 | 1.122 | 100 | 235 | 135 | 10 | 0.70 (0.43) | 54 |
| Example 135 | 0.033 | 85 | 205 | 120 | 25 | 0.77 (0.47) | 54 |
| Example 136 | 0.032 | 105 | 250 | 145 | 45 | 0.82 (0.45) | 50 |
| Example 137 | 0.028 | 95 | 230 | 135 | 10 | 0.70 (0.43) | 54 |
| Example 138 | 0.032 | 95 | 230 | 135 | 10 | 0.84 (0.51) | 54 |
| Example 139 | 0.033 | 105 | 230 | 125 | 25 | 0.60 (0.41) | 60 |
| Example 140 | 0.031 | 100 | 230 | 130 | 20 | 0.66 (0.45) | 60 |
| Example 141 | 0.032 | 95 | 220 | 125 | 25 | 0.62 (0.42) | 60 |
| Example 142 | 0.035 | 105 | 235 | 130 | 20 | 0.60 (0.41) | 60 |
| Example 143 | 0.034 | 100 | 230 | 130 | 20 | 0.62 (0.42) | 60 |
| Example 144 | 0.032 | 95 | 220 | 125 | 25 | 0.60 (0.41) | 60 |
| Example 145 | 0.026 | 105 | 230 | 125 | 25 | 0.63 (0.43) | 60 |
| Example 146 | 0.028 | 100 | 230 | 130 | 20 | 0.66 (0.45) | 60 |
| Example 147 | 0.520 | 105 | 230 | 125 | 25 | 0.62 (0.42) | 60 |
| Example 206 | 0.90 | 85 | 205 | 120 | 20 | 0.60 (0.37) | 43 |
| Example 207 | 0.91 | 95 | 230 | 135 | 10 | 0.66 (0.4) | 54 |
| Comparative Example 43 | — | 85 | 225 | 140 | | — (0.62) | |
| Comparative Example 44 | — | 90 | 225 | 135 | 5 | 1.03 (0.64) | 43 |
| Comparative Example 45 | — | 85 | 235 | 150 | −10 | 1.03 (0.64) | 43 |
| Comparative Example 46 | — | 90 | 230 | 140 | 0 | 1.00 (0.62) | 43 |
| Comparative Example 47 | — | 90 | 225 | 135 | 5 | 1.03 (0.64) | 43 |
| Comparative Example 48 | — | 90 | 230 | 140 | 0 | 1.02 (0.63) | 43 |
| Comparative Example 49 | — | 95 | 215 | 120 | | — (0.89) | |
| Comparative Example 50 | — | 90 | 280 | 190 | | — (0.55) | |
| Comparative Example 51 | — | 95 | 245 | 150 | | — (0.53) | |
| Comparative Example 52 | — | 95 | 230 | 135 | | — (0.53) | |
| Comparative Example 53 | — | 90 | 245 | 155 | | — (0.52) | |
| Comparative Example 54 | — | 100 | 245 | 145 | | — (0.61) | |
| Comparative Example 55 | — | 100 | 250 | 150 | −5 | 1.02 (0.62) | 54 |
| Comparative Example 56 | — | 95 | 245 | 150 | −5 | 1.03 (0.63) | 54 |
| Comparative Example 57 | — | 100 | 255 | 155 | −10 | 1.00 (0.61) | 54 |
| Comparative Example 58 | — | 95 | 240 | 145 | 0 | 0.98 (0.6) | 54 |
| Comparative Example 59 | — | 90 | 245 | 155 | −10 | 0.98 (0.6) | 54 |
| Comparative Example 60 | — | 110 | 260 | 150 | | — (0.68) | |

Herein, the "coefficient of kinetic friction" of each of Examples and Comparative Examples in Tables 14 to 17 represents the relative value of the coefficient of kinetic friction of the electrophotographic photosensitive member for control, and the numerical value within the bracket represents the measured value of the coefficient of kinetic friction. The "amount of reduction in variation in light area potential" represents the difference from the amount of variation in light area potential of the electrophotographic photosensitive member for control. Herein, the amounts of reduction in variation in light area potential in some Comparative Examples, having a minus value, mean that each amount of variation is increased as compared with the amount of variation in light area potential of the electrophotographic photosensitive member for control.

In comparing Examples with Comparative Examples, the surface layer of the electrophotographic photosensitive member containing the resin having a siloxane structure at the end and further containing the compound γ exhibits the effect of reducing the initial friction coefficient and also suppressing the variation in light area potential due to the repeating use. On the other hand, the comparison of Comparative Example 32 with Comparative Example 33 suggests that the case where a dimethylsilicone oil is used does not impart the effect by containing the compound γ, of suppressing the variation in potential due to the repeating use. In such a dimethylsilicone oil, the uniformity in film of the surface layer is significantly lowered, and thus there is a need for an improvement as an electrophotographic photosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2011-166764, filed Jul. 29, 2011, and No. 2012-123499 filed May 30, 2012 which are hereby incorporated by reference herein in their entirety.

What is claimed is:

1. An electrophotographic photosensitive member, comprising:

a support;

a photosensitive layer formed on the support;

wherein a surface layer of the electrophotographic photosensitive member comprises:

(α) at least one resin selected from the group consisting of a polycarbonate resin not having a siloxane structure at the end, and a polyester resin not having a siloxane structure at the end;

(β) at least one resin selected from the group consisting of a polycarbonate resin having a siloxane structure represented by the following formula (D-S) at the end thereof a polyester resin having a siloxane structure represented by the following formula (D-S) at the end thereof, and an acrylic resin having a siloxane structure represented by the following formula (F-1- 2) at the end thereof:

(D-S)

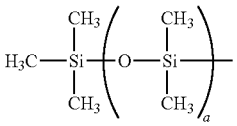

wherein

"a" represents the number of the repetition of the structure within the bracket, (F-1-2)

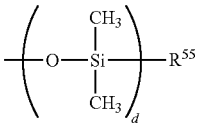

wherein

"d" represents the number of the repetition of the structure within the bracket, and $R^{55}$ represents a hydroxyl group or a methyl group; and (γ) at least one compound selected from the group consisting of a methyl benzoate, an ethyl benzoate, a benzyl acetate, ethyl 3-ethoxypropionate, and a diethylene glycol ethyl methyl ether.

2. The electrophotographic photosensitive member according to claim 1, wherein a content of the above (γ) is not less than 0.001% by mass and not more than 1% by mass based on the total mass of the surface layer.

3. The electrophotographic photosensitive member according to claim 2, wherein a content of the above (γ) is not less than 0.001% by mass and not more than 0.5% by mass based on the total mass of the surface layer.

4. The electrophotographic photosensitive member according to claim 1, wherein the polycarbonate resin not having a siloxane structure at the end is a polycarbonate resin A having a repeating structural unit represented by the following formula (A):

(A)

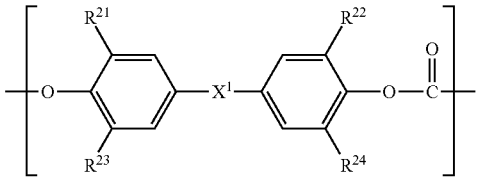

wherein $R^{21}$ to $R^{24}$ each independently represent a hydrogen atom, or a methyl group, and $X^1$ represents a single bond, a cyclohexylidenc group, or a bivalent group having a structure represented by the following formula (C):

(C)

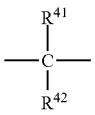

wherein $R^{41}$ and $R^{42}$ each independently represent a hydrogen atom, a methyl group, or a phenyl group.

5. The electrophotographic photosensitive member according to claim 1, wherein the polyester resin not having a siloxane structure at the end is a polyester resin B having a repeating structural unit represented by the following formula (B):

(B)

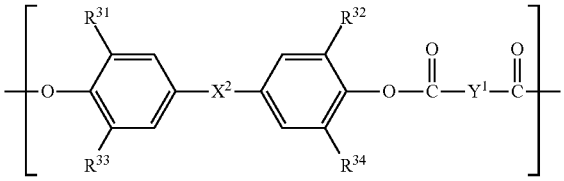

wherein $R^{31}$ to $R^{34}$ each independently represent a hydrogen atom, or a methyl group, $X^2$ represents a single bond, a cyclohexylidene group, or a bivalent group having a structure represented by the following formula (C), and $Y^1$ represents a m-phenylene group, a p-phenylene group, or a bivalent group having two p-phenylene groups bonded with an oxygen atom:

(C)

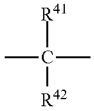

wherein $R^{41}$ and $R^{42}$ each independently represent a hydrogen atom, a methyl group, or a phenyl group.

6. The electrophotographic photosensitive member according to claim 1, wherein the polycarbonate resin having a siloxane structure represented by the formula (D-S) at the end is a polycarbonate resin D having a repeating structural unit represented by the following formula (A') and an end structure represented by the following formula (D):

(A')

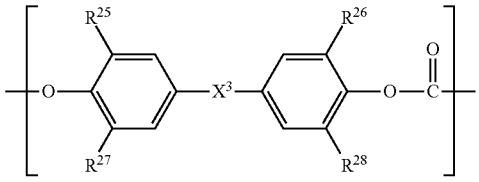

wherein $R^{25}$ to $R^{28}$ each independently represent a hydrogen atom, or a methyl group, and $X^3$ represents a single bond, a cyclohexylidene group, or a bivalent group having a structure represented by the following formula (C'):

(C')

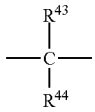

wherein $R^{43}$ $R^{44}$ each independently represent a hydrogen atom, a methyl group, or a phenyl group; and (D)

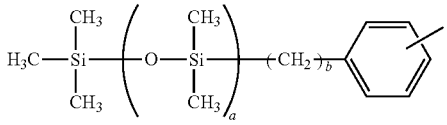

wherein

"a" and b" each independently represent a number of repetitions of a structure enclosed in the parentheses, an average of "a"in the polycarbonate resin D is not less than 20 and not more than 100, and an average of "b" in the polycarbonate resin D is not less than 1 and not more than 10.

7. The electrophotographic photosensitive member according to claim 1, wherein the polyester resin having a siloxane structure represented by the formula (D-S) at the end is a polyester resin E having a repeating structural unit represented by the following formula (B') and an end structure represented by the following formula (D):

(B')

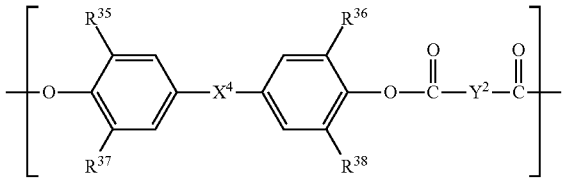

wherein $R^{35}$ to $R^{38}$ each independently represent a hydrogen atom, or a methyl group, $X^4$ represents a single bond, a cyclohexylidene group, or a bivalent group having a structure represented by the following formula (C'), and $Y^2$ represents a m-phenylene group, a p-phenylene group, or a bivalent group having two p-phenylene groups bonded with an oxygen atom:

(C')

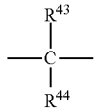

wherein $R^{43}$ and $R^{44}$ each independently represent a hydrogen atom, a methyl group, or a phenyl group; and (D)

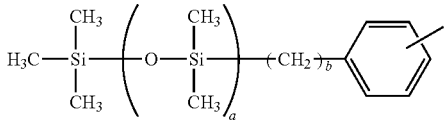

wherein

"a" and "b" each independently represent a number of repetitions of a structure enclosed in the parentheses, an average of "a" in the polyester resin E is not less than 20 and not more than 100, and an average of "b" in the polyester resin E is not less than 1 and not more than 10.

8. The electrophotographic photosensitive member according to claim 1, wherein the acrylic resin having a siloxane structure represented by the formula (F-1- 2) at the end is an acrylic resin F having a repeating structural unit represented by the following formula (F-1) and a repeating structural unit represented by the following formula (F-2), or an acrylic resin F having a repeating structural unit represented by the following formula (F-1) and a repeating structural unit represented by the following formula (F-3):

(F-1)

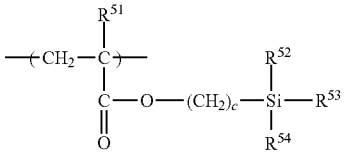

wherein $R^{51}$ represents a hydrogen atom, or a methyl group,

"c" represents a number of repetitions of a structure enclosed in the parentheses, an average of "c" in the acrylic resin F is not less than 0 and not more than 5, and $R^{52}$ to $R^{54}$ each independently represent a structure represented by the following formula (F-1-2), a methyl group, a methoxy group, or a phenyl group:

(F-1-2)

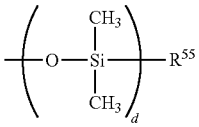

wherein

"d" represents a number of repetitions of a structure enclosed in the parentheses, an average of "d" in the acrylic resin F is not less than 10 and not more than 50, and $R^{55}$ represents a methyl group, or a hydroxyl group; and (F-2)

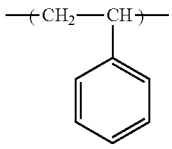

(F-3)

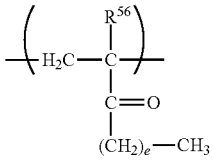

wherein $R^{56}$ represents a hydrogen group, a methyl group, or a phenyl group, and "e" is 0 or 1.

9. The electrophotographic photosensitive member according to claim 1, wherein a content of the (β) in the surface layer is not less than 1% by mass and not more than 50% by mass based on the total mass of the (α).

10. A process cartridge detachably attachable to a main body of an electrophotographic apparatus, wherein the process cartridge integrally supports:

an electrophotographic photosensitive member according to claim 1, and at least one device selected from the group consisting of a charging device, a developing device, a transferring device, and a cleaning device.

11. An electrophotographic apparatus comprising:

an electrophotographic photosensitive member according to claim 1;

a charging device;

an exposure device;

a developing device; and a transferring device.

12. The electrophotographic photosensitive member according to claim 1, wherein the photosensitive layer comprises a charge generation layer and a charge transport layer formed on the charge generation layer, and wherein the charge transport layer is the surface layer.

* * * * *